US008419378B2

(12) United States Patent
Fenton et al.

(10) Patent No.: US 8,419,378 B2
(45) Date of Patent: Apr. 16, 2013

(54) JET PUMP

(75) Inventors: Marcus Brian Mayhall Fenton, Cambridgeshire (GB); Alexander Guy Wallis, Adelaide (AU)

(73) Assignee: Pursuit Dynamics PLC, Cambridgeshire (GB)

( * ) Notice: Subject to any disclaimer, the term of this patent is extended or adjusted under 35 U.S.C. 154(b) by 1063 days.

(21) Appl. No.: 11/658,265

(22) PCT Filed: Jul. 29, 2005

(86) PCT No.: PCT/GB2005/002999

§ 371 (c)(1),
(2), (4) Date: Jan. 24, 2007

(87) PCT Pub. No.: WO2006/010949

PCT Pub. Date: Feb. 2, 2006

(65) Prior Publication Data

US 2008/0310970 A1 Dec. 18, 2008

(30) Foreign Application Priority Data

| | | |
|---|---|---|
| Jul. 29, 2004 | (GB) | 0416914.0 |
| Jul. 29, 2004 | (GB) | 0416915.7 |
| Aug. 12, 2004 | (GB) | 0417961.0 |
| Dec. 24, 2004 | (GB) | 0428343.8 |

(51) Int. Cl.
*F04F 5/36* (2006.01)
*F04F 5/44* (2006.01)
*F04F 5/48* (2006.01)

(52) U.S. Cl.
USPC ..... 417/187; 417/53; 417/197

(58) Field of Classification Search ..... 137/896; 417/54, 76, 187, 189, 198; 239/8, 433
See application file for complete search history.

(56) References Cited

U.S. PATENT DOCUMENTS

| | | | |
|---|---|---|---|
| 1,004,770 | A | 10/1911 | Galloway |
| 1,289,812 | A | 12/1918 | Kinney |

(Continued)

FOREIGN PATENT DOCUMENTS

| | | |
|---|---|---|
| CA | 833980 | 2/1970 |
| CN | 2356760 | 1/2000 |

(Continued)

OTHER PUBLICATIONS

International Search Report.

(Continued)

*Primary Examiner* — Charles Freay
*Assistant Examiner* — Philip Stimpert
(74) *Attorney, Agent, or Firm* — Bryan Cave LLP

(57) ABSTRACT

A fluid mover (1) includes a hollow body (2) provided with a straight-through passage (3) of substantially constant cross section with an inlet end (4) an outlet end (5) for the entry and discharge respectively of a working fluid. A nozzle (16) substantially circumscribes and opens into the passage (3) intermediate the inlet (4) and outlet (5) ends. An inlet (10) communicates with the nozzle (16) for the introduction of a transport fluid and a mixing chamber (3A) is formed within the passage (3) downstream of the nozzle (16). The nozzle internal geometry and the bore profile immediately upstream of the nozzle exit are disposed and configured to optimise the energy transfer between the transport fluid and working fluid. In use, through the introduction of transport fluid, the working fluid or fluids are atomized to form a dispersed vapor/droplet flow regime with locally supersonic flow conditions within a pseudo-vena contracta, resulting in the creation of a supersonic condensation shock wave (17) within the downstream mixing chamber (3A) by the condensation of the transport fluid. Methods of moving and processing fluids using the fluid mover are also disclosed.

11 Claims, 9 Drawing Sheets

U.S. PATENT DOCUMENTS

| | | | | |
|---|---|---|---|---|
| 1,592,448 | A | 7/1926 | Debus | |
| 2,083,801 | A | 6/1937 | Eddy | |
| 2,396,290 | A * | 3/1946 | Schwarz | 417/170 |
| 2,971,325 | A | 2/1961 | Gongwer | |
| 3,259,320 | A | 7/1966 | Christian | |
| 3,265,027 | A | 8/1966 | Brown | |
| 3,304,564 | A | 2/1967 | Green | |
| 3,402,555 | A | 9/1968 | Piper | |
| 3,411,301 | A | 11/1968 | Olsen | |
| 3,456,871 | A | 7/1969 | Gosling | |
| 3,493,191 | A | 2/1970 | Hughes | |
| 3,529,320 | A | 9/1970 | Kerns et al. | |
| 3,664,768 | A | 5/1972 | Mays et al. | |
| 3,799,195 | A | 3/1974 | Hermans | |
| 3,823,929 | A | 7/1974 | Rymarchyk | |
| 3,889,623 | A | 6/1975 | Arnold | |
| 3,984,504 | A | 10/1976 | Pick | |
| 4,014,961 | A | 3/1977 | Popov | |
| 4,072,470 | A | 2/1978 | Tsuto et al. | |
| 4,101,246 | A | 7/1978 | Erikson | |
| 4,157,304 | A | 6/1979 | Molvar | |
| 4,175,706 | A | 11/1979 | Gerstmann | |
| 4,192,465 | A | 3/1980 | Hughes | |
| 4,201,596 | A | 5/1980 | Burroughs et al. | |
| 4,212,168 | A | 7/1980 | Bouchard et al. | |
| 4,221,558 | A | 9/1980 | Santisi | |
| 4,279,663 | A | 7/1981 | Burroughs et al. | |
| 4,425,433 | A | 1/1984 | Neves | |
| 4,461,648 | A | 7/1984 | Foody | |
| 4,487,553 | A | 12/1984 | Nagata | |
| 4,595,344 | A * | 6/1986 | Briley | 417/185 |
| 4,659,521 | A | 4/1987 | Alleman | |
| 4,718,870 | A | 1/1988 | Watts | |
| 4,738,614 | A | 4/1988 | Snyder et al. | |
| 4,809,911 | A | 3/1989 | Ryan | |
| 4,836,451 | A | 6/1989 | Herrick et al. | |
| 4,915,300 | A | 4/1990 | Ryan | |
| 4,915,302 | A | 4/1990 | Kraus et al. | |
| 5,014,790 | A | 5/1991 | Papavergos | |
| 5,061,406 | A | 10/1991 | Cheng | |
| 5,138,937 | A | 8/1992 | Zietlow | |
| 5,171,090 | A | 12/1992 | Weimars | |
| 5,205,648 | A | 4/1993 | Fissenko | |
| 5,240,724 | A | 8/1993 | Otto et al. | |
| 5,249,514 | A | 10/1993 | Otto et al. | |
| 5,252,298 | A | 10/1993 | Jones | |
| 5,269,461 | A | 12/1993 | Davis | |
| 5,275,486 | A | 1/1994 | Fissenko | |
| 5,312,041 | A | 5/1994 | Williams et al. | |
| 5,323,967 | A | 6/1994 | Tanaka et al. | |
| 5,338,113 | A | 8/1994 | Fisenko | |
| 5,344,345 | A | 9/1994 | Nagata | |
| 5,366,288 | A | 11/1994 | Dahllof et al. | |
| 5,492,276 | A | 2/1996 | Kaylor | |
| 5,495,893 | A | 3/1996 | Roberts et al. | |
| 5,520,331 | A | 5/1996 | Wolfe | |
| 5,544,961 | A | 8/1996 | Fuks et al. | |
| 5,597,044 | A | 1/1997 | Roberts et al. | |
| 5,598,700 | A | 2/1997 | Varshay et al. | |
| 5,615,836 | A | 4/1997 | Graef | |
| 5,661,968 | A | 9/1997 | Gabriel | |
| 5,692,371 | A | 12/1997 | Varshay et al. | |
| 5,738,762 | A | 4/1998 | Ohsol | |
| 5,779,159 | A | 7/1998 | Williams et al. | |
| 5,810,252 | A | 9/1998 | Pennamen et al. | |
| 5,851,139 | A | 12/1998 | Xu | |
| 5,857,773 | A | 1/1999 | Tammelin | |
| 5,860,598 | A | 1/1999 | Cruz | |
| 5,863,128 | A | 1/1999 | Mazzei | |
| 6,003,789 | A | 12/1999 | Base et al. | |
| 6,029,911 | A | 2/2000 | Watanabe et al. | |
| 6,065,683 | A | 5/2000 | Akin et al. | |
| 6,098,896 | A | 8/2000 | Haruch | |
| 6,110,356 | A | 8/2000 | Hedrick et al. | |
| 6,200,486 | B1 | 3/2001 | Chahine et al. | |
| 6,299,343 | B1 | 10/2001 | Pekerman | |
| 6,308,740 | B1 * | 10/2001 | Smith et al. | 137/892 |
| 6,338,444 | B1 | 1/2002 | Swan | |
| 6,371,388 | B2 | 4/2002 | Utter et al. | |
| 6,405,944 | B1 | 6/2002 | Benalikhoudja | |
| 6,456,871 | B1 | 9/2002 | Hsu et al. | |
| 6,478,240 | B1 | 11/2002 | Dorkin et al. | |
| 6,502,979 | B1 | 1/2003 | Kozyuk | |
| 6,503,461 | B1 | 1/2003 | Burgard et al. | |
| 6,523,991 | B1 | 2/2003 | Maklad | |
| 6,623,154 | B1 | 9/2003 | Garcia | |
| 6,637,518 | B1 | 10/2003 | Hillier et al. | |
| 6,662,549 | B2 | 12/2003 | Burns | |
| 6,796,704 | B1 | 9/2004 | Lott | |
| 6,802,638 | B2 | 10/2004 | Allen | |
| 6,830,368 | B2 | 12/2004 | Fukano | |
| 6,969,012 | B2 | 11/2005 | Kangas et al. | |
| 7,029,165 | B2 | 4/2006 | Allen | |
| 7,040,551 | B2 | 5/2006 | Rummel | |
| 7,080,793 | B2 | 7/2006 | Borisov et al. | |
| 7,111,975 | B2 | 9/2006 | Fenton et al. | |
| 7,207,712 | B2 | 4/2007 | Kozyuk | |
| 7,667,082 | B2 | 2/2010 | Kozyuk | |
| 2002/0162518 | A1 | 11/2002 | Dumaz et al. | |
| 2003/0147301 | A1 | 8/2003 | Ekholm | |
| 2003/0150624 | A1 | 8/2003 | Rummel | |
| 2004/0065589 | A1 | 4/2004 | Jorgensen | |
| 2004/0141410 | A1 * | 7/2004 | Fenton et al. | 366/163.2 |
| 2004/0188104 | A1 | 9/2004 | Borisov et al. | |
| 2004/0222317 | A1 | 11/2004 | Huffman | |
| 2005/0000700 | A1 | 1/2005 | Sundholm | |
| 2005/0011355 | A1 | 1/2005 | Williams et al. | |
| 2005/0150971 | A1 | 7/2005 | Zhou | |
| 2005/0266539 | A1 | 12/2005 | Hochberg et al. | |
| 2006/0102351 | A1 | 5/2006 | Crabtree et al. | |
| 2006/0102749 | A1 | 5/2006 | Crabtree et al. | |
| 2006/0144760 | A1 | 7/2006 | Duyvesteyn et al. | |
| 2007/0000700 | A1 | 1/2007 | Switzer | |
| 2007/0095946 | A1 | 5/2007 | Ryan | |
| 2007/0128095 | A1 | 6/2007 | Brockmann et al. | |
| 2007/0210186 | A1 | 9/2007 | Fenton et al. | |
| 2008/0230632 | A1 | 9/2008 | Fenton et al. | |
| 2008/0310970 | A1 | 12/2008 | Fenton et al. | |
| 2009/0052275 | A1 | 2/2009 | Jansson | |
| 2009/0072041 | A1 | 3/2009 | Hashiba | |
| 2009/0240088 | A1 | 9/2009 | Fenton et al. | |
| 2009/0314500 | A1 | 12/2009 | Fenton et al. | |
| 2010/0085833 | A1 | 4/2010 | Zaiser | |
| 2010/0129888 | A1 | 5/2010 | Thorup et al. | |
| 2010/0230119 | A1 | 9/2010 | Worthy | |
| 2010/0233769 | A1 | 9/2010 | Heathcote et al. | |
| 2010/0301129 | A1 | 12/2010 | Fenton et al. | |

FOREIGN PATENT DOCUMENTS

| | | |
|---|---|---|
| DE | 3316233 | 11/1984 |
| EP | 0282061 | 3/1988 |
| EP | 0362052 | 10/1991 |
| EP | 0471321 | 11/1995 |
| EP | 0889244 | 1/1999 |
| EP | 0911082 | 4/1999 |
| EP | 1072320 | 1/2001 |
| EP | 1163931 | 12/2001 |
| EP | 1034029 | 3/2003 |
| EP | 1421996 | 5/2004 |
| EP | 1549856 | 6/2007 |
| EP | 2070881 | 6/2009 |
| FR | 474904 | 3/1915 |
| FR | 1354965 | 3/1964 |
| FR | 2376384 | 7/1978 |
| FR | 2613639 | 10/1988 |
| GB | 995660 | 6/1965 |
| GB | 1028211 | 5/1966 |
| GB | 1205776 | 9/1970 |
| GB | 1 227 444 | 4/1971 |
| GB | 2207952 | 7/1988 |
| GB | 2242370 | 11/1993 |
| GB | 2 313 410 | 11/1997 |
| GB | 2384027 | 1/2002 |
| GB | 0223572.9 | 10/2002 |
| GB | 0227053.6 | 11/2002 |
| GB | 0301236.6 | 6/2003 |
| GB | 0404230.5 | 2/2004 |

| | | |
|---|---|---|
| GB | 0405363.3 | 3/2004 |
| GB | 0406690.8 | 3/2004 |
| GB | 0407090.0 | 3/2004 |
| GB | 0409620.2 | 4/2004 |
| GB | 0410518.5 | 5/2004 |
| GB | 0416914.0 | 7/2004 |
| GB | 0416915.7 | 7/2004 |
| GB | 0417961.0 | 8/2004 |
| GB | 0428343.8 | 12/2004 |
| GB | 0500580.6 | 1/2005 |
| GB | 0500581.4 | 1/2005 |
| GB | 0618196.0 | 9/2006 |
| GB | 0708482.5 | 5/2007 |
| GB | 0710659.4 | 6/2007 |
| GB | 0710663.6 | 6/2007 |
| GB | 0721995.9 | 11/2007 |
| GB | 0803959.6 | 3/2008 |
| GB | 0805791.1 | 3/2008 |
| GB | 0806182.2 | 4/2008 |
| GB | 0810155.2 | 6/2008 |
| GB | 0818362.6 | 10/2008 |
| JP | 03-260405 | 11/1991 |
| JP | 4184000 | 6/1992 |
| JP | 10141299 | 5/1998 |
| JP | 10-226503 | 8/1998 |
| JP | 2001-354319 | 12/2001 |
| JP | 2003-515702 | 5/2003 |
| NL | 7409053 | 1/1975 |
| RU | 2142580 | 12/1999 |
| RU | 2152465 | 7/2000 |
| SU | 1653853 | 6/1991 |
| SU | 2040322 | 5/1992 |
| WO | 8907204 | 8/1989 |
| WO | 8910184 | 11/1989 |
| WO | WO 92/20453 | 11/1992 |
| WO | WO 92/20454 | 11/1992 |
| WO | WO 94/08724 | 4/1994 |
| WO | WO 97/00373 | 1/1997 |
| WO | WO 97/38757 | 10/1997 |
| WO | PCT/US98/05275 | 3/1998 |
| WO | PCT/RU97/00299 | 9/1998 |
| WO | 0002653 | 1/2000 |
| WO | WO 00/71235 | 1/2000 |
| WO | WO 00/09236 | 2/2000 |
| WO | PCT/RU00/00118 | 4/2000 |
| WO | WO 00/37143 | 6/2000 |
| WO | WO 01/36105 | 5/2001 |
| WO | WO 01/76764 | 10/2001 |
| WO | WO 01/94197 | 12/2001 |
| WO | WO 03/030995 | 4/2003 |
| WO | WO 03/061769 | 7/2003 |
| WO | WO 03/072952 | 9/2003 |
| WO | 2004/033920 | 4/2004 |
| WO | WO 2004/038031 | 6/2004 |
| WO | WO 2004/057196 | 7/2004 |
| WO | PCT/GB2005/000708 | 2/2005 |
| WO | PCT/GB2005/000720 | 2/2005 |
| WO | WO 2005/082546 | 9/2005 |
| WO | WO 2005/115555 | 12/2005 |
| WO | WO 2005/123263 | 12/2005 |
| WO | WO 2006/010949 | 2/2006 |
| WO | WO 2006/024242 | 3/2006 |
| WO | WO 2006/034590 | 4/2006 |
| WO | WO 2006/132557 | 12/2006 |
| WO | WO 2007/037752 | 4/2007 |
| WO | PCT/GB2007/003492 | 9/2007 |
| WO | WO 2008/062218 | 5/2008 |
| WO | PCT/GB2008/001883 | 6/2008 |
| WO | PCT/GB2008/051042 | 11/2008 |
| WO | PCT/US2008/012571 | 11/2008 |
| WO | WO 2008/135775 | 11/2008 |
| WO | WO 2008/135783 | 11/2008 |
| WO | WO 2009/060240 | 5/2009 |
| WO | PCT/GB2009/050626 | 6/2009 |
| WO | WO 2009/147443 | 12/2009 |
| WO | WO 2010/003090 | 1/2010 |
| WO | WO 2010/041080 | 4/2010 |
| WO | WO 2010/049815 | 5/2010 |

OTHER PUBLICATIONS

Patent Abstracts of Japan, JP 03-260405, published Nov. 20, 1991.
Patent Abstracts of Japan, vol. 016, No. 498 (M-1325), Oct. 15, 1992 & JP 04 184000 A (Mitsui Eng & Shipbuild Co Ltd), Jun. 30, 1992.
Final Scientific Report, "New Regenerative Cycle for Vapor Compression Refrigeration", DE-FG36-04GO14327.
Cincotta, "From the Lab to Production: Direct Steam Injection Heating of Fibrous Slurries", Biomass Magazine, Jul. 1, 2000.
Khanal, et al., "Ultrasound Enhanced Glucose Release From Corn in Ethanol Plants", Biotechnology and Bioengineering, vol. 98, No. 5, pp. 978-985, Dec. 1, 2007.
Hagen, Energy economy by continuous steaming and mashing, International Food Information Service (IFIS), Frankfurt-Main, DE (Abstract) (1984).
Patent Abstracts of Japan, vol. 2002, No. 4, Aug. 4, 2002 & JP 2001 354319 A (Ogawa Jidosha:KK), Dec. 25, 2001.
Arvidson, et al., The VINNOVA water mist research project: A description of the 500 m3 machinery space tests, SP Swedish National Testing and Research Institute, SP Fire Technology, SP Report 2003:19.
Dlugogorski, et al., Water Vapour as an Ineiting Agent, Halon Options Technical Working Conference, pp. 7-18 (May 6-8, 1997).
High pressure water mist for efficient fire protection, Engineer Live (Oct. 8, 2007).
Kim, Andrew, Overview of Recent Progress in Fire Suppression Technology, Institute for Research in Construction, NRCC-45690, Invited Keynote Lecture of the 2nd NRIFD Symposium, Proceedings, Tokyo, Japan, Jul. 17-19, 2002, pp. 1-13.
Liu, et al., A Review of water mist fire suppression systems—fundamental studies, National Research Council Canada (2000).
Liu, et al., A Review of water mist fire suppression technology: Part II—Application studies, National Research Council Canada (Feb. 2001).
Liu, et al., Review of Three Dimensional Water Fog Techniques for Firefighting, National Research Council Canada (Dec. 2002).
Mawhinney, et al., A State-of-the-Art Review of Water Mist Fire Suppression Research and Development—1996, National Research Council Canada (Jun. 1996).
Mawhinney, et al., Report of the Committee on Water Mist Fire Suppression Systems, NFPA 750, pp. 141-147 (Nov. 2002 ROC).
Nigro, et al., Water Mist Fire Protection Solution for the Under-Roof Areas of the La Scala Theatre in Milan.
PDX® FireMist Comparative Data, Pursuit Dynamics pic (Jul. 1, 2005).
Schlosser, et al., In Situ Determination of Molecular Oxygen Concentrations in Full•Scale Fire Suppression Tests Using TDLAS, The 2nd Joint Meeting of the US Sections of the Combustion Institute, Oakland, CA (Mar. 28, 2001).
Vaari, A Study of Total Flooding Water Mist Fire Suppression System Performance using a Transient One-Zone Computer Model, Fire Technology, 37, 327-342 (2001).
Fire Suppression by Water Mist, Naval Research Laboratory, Washington, DC and Physikalisch-Chemisches Institut, Universitat Heidelberg.
Machine English language translation by EPO of FR 1354965.

* cited by examiner

JET PUMP

This application is the US national phase of international application PCT/GB2005/002999 filed 29 Jul. 2005 which designated the U.S. and claims benefit of GB 0416914.0; GB 0416915.7; GB 0417961.0 and GB 0428343.8, dated 29 Jul. 2004; 29 Jul. 2004; 12 Aug. 2004 and 24 Dec. 2004, respectively, the entire content of which is hereby incorporated by reference.

This invention relates to a method and apparatus for moving a fluid.

The present invention has reference to improvements to a fluid mover having a number of practical applications of diverse nature ranging from marine propulsion systems to pumping applications for moving and/or mixing fluids and/or solids of the same or different characteristics. The present invention also has relevance in the fields inter alia of heating, cooking, cleaning, aeration, gas fluidisation, and agitation of fluids and fluids/solids mixtures, particle separation, classification, disintegration, mixing, emulsification, homogenisation, dispersion, maceration, hydration, atomisation, droplet production, viscosity reduction, dilution, shear thinning, transport of thixotropic fluids and pasteurisation.

More particularly the invention is concerned with the provision of an improved fluid mover having essentially no moving parts.

Ejectors are well known in the art for moving working or process fluids by the use of either a central or an annular jet which emits steam into a duct in order to move the fluids through or out of appropriate ducting or into or through another body of fluid. The ejector principally operates on the basis of inducing flow by creating negative pressure, generally by the use of the venturi principle. The majority of these systems utilise a central steam nozzle where the induced fluid generally enters the duct orthogonally to the axis of the jet, although there are exceptions where the reverse arrangement is provided. The steam jet is accelerated through an expansion nozzle into a mixing chamber where it impinges on and is mixed with working fluid. The mixture of working fluid and steam is accelerated to higher velocities within a downstream convergent section prior to a divergent section, e.g. a venturi. The pressure gradient generated in the venturi induces new working fluid to enter the mixing chamber. The energy transfer mechanism in most steam ejector systems is a combination of momentum, heat and mass transfer but by varying proportions. Many of these systems employ the momentum transfer associated with a converging flow, while others involve the generation of a shock wave in the divergent section. One of the major limitations of the conventional convergent/divergent systems is that their performance is very sensitive to the position of the shock wave which tends to be unstable, easily moving away from its optimum position. It is known that if the shock wave develops in the wrong place within the convergent/divergent sections, the relevant unit may well stall. Such systems can also only achieve a shock wave across a restricted section.

Furthermore, for systems which employ a central steam nozzle, the throat dimension restriction and the sharp change of direction affecting the working fluid presents a serious limitation on the size of any particulate throughput and certainly any rogue material that might enter the system could cause blockage.

An improved fluid mover is described in our International Patent Application No PCT/GB2003/004400 in which the interaction of a working fluid or fluids and a transport fluid projected from a nozzle arrangement provides pumping, entrainment, mixing, heating, emulsification, and homogenization etc. of the working fluid or fluids. The fluid mover introduces an annular supersonic jet of transport fluid, typically steam, into a relatively large diameter straight through hollow passage. Through a combination of momentum transfer, high shear, and the generation of a condensation shock wave, the high velocity steam induces and acts upon the working fluid passing through the centre of the hollow body.

PCT/GB2003/004400 describes that the transport fluid is preferably a condensable fluid and may be a gas or vapour, for example steam, which may be introduced in either a continuous or discontinuous manner. At or near the point of introduction of the transport fluid, for example immediately downstream thereof, a pseudo-vena contracta or pseudo convergent/divergent section is generated, akin to the convergent/divergent section of conventional steam ejectors but without the physical constraints associated therewith since the relevant section is formed by the effect of the steam impacting upon the working or process fluid. Accordingly the fluid mover is more versatile than conventional ejectors by virtue of a flexible fluidic internal boundary described by the pseudo-vena contracta. The flexible boundary lies between the working fluid at the centre and the solid wall of the unit, and allows disturbances or pressure fluctuations in the multi phase flow to be accommodated better than for a solid wall. This advantageously reduces the supersonic velocity within the multi phase flow, resulting in better droplet dispersion, increasing the momentum transfer zone length, thus producing a more intense condensation shock wave.

PCT/GB2003/004400 further discloses that the positioning and intensity of the shock wave is variable and controllable depending upon the specific requirements of the system in which the fluid mover is disposed. The mechanism relies on a combination of effects in order to achieve its high versatility and performance, notably heat, momentum and mass transfer which gives rise to the generation of the shock wave and also provides for shearing of the working fluid flow on a continuous basis by shear dispersion and/or dissociation. Preferably the nozzle is located as close as possible to the projected surface of the working fluid in practice and in this respect a knife edge separation between the transport fluid or steam and the working fluid stream is of advantage in order to achieve the requisite degree of interaction. The angular orientation of the nozzle with respect to the working fluid stream is of importance and may be shallow.

Further, PCT/GB2003/004400 discloses that the or each transport fluid nozzle may be of a convergent-divergent geometry internally thereof, and in practice the nozzle is configured to give the supersonic flow of transport fluid within the passage. For a given steam condition, i.e. dryness, pressure and temperature, the nozzle is preferably configured to provide the highest velocity steam jet, the lowest total pressure drop and the highest static enthalpy between the steam chamber and the nozzle exit. The nozzle is preferably configured to avoid any shock in the nozzle itself. For example only, and not by way of limitation, an optimum area ratio for the nozzle, namely exit area: throat area, lies in the range 1.75 and 7.5, with an included angle of less than 9°.

The or each nozzle is conveniently angled towards the working fluid flow and also faces generally towards the cutlet of the fluid mover. This helps penetration of the working fluid by the transport fluid, which may help shear or thermal dispersion of the working fluid. This may also prevent both kinetic energy dissipation on the wall of the passage and premature condensation of the steam at the wall of the passage, where an adverse temperature differential prevails. The angular orientation of the nozzles is selected for optimum performance which is dependent inter alia on the nozzle orientation and the internal geometry of the mixing chamber. Further the angular orientation of the or each nozzle is selected to control the pseudo-convergent/divergent profile, the pressure profile within the mixing chamber, the enthalpy addition and the condensation shock wave intensity or position in accordance with the pressure and flow rates required from the fluid mover. Moreover, the creation of turbulence, governed inter alia by the angular orientation of the nozzle, is important to achieve optimum performance by dispersal of the working fluid to a vapour-droplet phase in order to increase acceleration by momentum transfer. This aspect is of particular importance when the fluid mover is employed as a pump. For example, and not by way of limitation, in the present invention it has been found that an angular orientation for the or each nozzle may lie in the range 0 to 30° with respect to the flow direction of the working fluid.

A series of nozzles with respective mixing chamber sections associated therewith may be provided longitudinally of the passage and in this instance the nozzles may have different angular orientations, for example decreasing from the first nozzle in a downstream direction. Each nozzle may have a different function from the other or others, for example pumping, mixing, disintegrating, and may be selectively brought into operation in practice. Each nozzle may be configured to give the desired effects upon the working fluid. Further, in a multi-nozzle system by the introduction of the transport fluid, for example steam, phased heating may be achieved. This approach may be desirable to provide a gradual heating of the working fluid.

An object of the present invention is to improve the performance of the fluid mover by enhancing the energy transfer mechanism between the high velocity transport fluid and the working fluid. This improves the performance of the fluid mover having essentially no moving parts having an improved performance than fluid movers currently available in the absence of any constriction such as is exemplified in the prior art recited in the aforementioned patent.

According to a first aspect of the present invention a fluid mover includes a hollow body provided with a straight-through passage of substantially constant cross section with an inlet at one end of the passage and an outlet at the other end of the passage for the entry and discharge respectively of a working fluid, a nozzle substantially circumscribing and opening into said passage intermediate the inlet and outlet ends thereof, an inlet communicating with the nozzle for the introduction of a transport fluid, a mixing chamber being formed within the passage downstream of the nozzle, the nozzle internal geometry and the bore profile immediately upstream of the nozzle exit being so disposed and configured to optimise the energy transfer between the transport fluid and working fluid that in use through the introduction of transport fluid the working fluid or fluids are atomised to form a dispersed vapour/droplet flow regime with locally supersonic flow conditions within a pseudo-vena contracta, resulting in the creation of a supersonic condensation shock wave within the downstream mixing chamber by the condensation of the transport fluid.

The transport fluid is preferably a condensable fluid and may be a gas or vapour, for example steam, which may be introduced in either a continuous or discontinuous manner.

According to a second aspect of the present invention a fluid mover of the kind described in our aforementioned patent application, includes a hollow body provided with a straight-through passage of substantially constant cross section with an inlet at one end of the passage and an outlet at the other end of the passage for the entry and discharge respectively of a working fluid, a nozzle substantially circumscribing and opening into said passage intermediate the inlet and outlet ends thereof, an inlet communicating with the nozzle for the introduction of steam, a mixing chamber being formed within the passage downstream of the nozzle, the nozzle internal geometry and the bore profile immediately upstream of the nozzle exit being so disposed and configured to optimise the energy transfer between the steam and working fluid that in use through the introduction of steam the working fluid or fluids are atomised to form a dispersed vapour/droplet flow regime with locally supersonic flow conditions within a pseudo-vena contracta, resulting in the creation of a supersonic condensation shock wave within the downstream mixing chamber by the condensation of the steam.

The nozzle may be of a form to correspond with the shape of the passage and thus for example a circular passage would advantageously be provided with an annular nozzle circumscribing it. The term 'annular' as used herein is deemed to embrace any configuration of nozzle or nozzles that circumscribes the passage of the fluid mover, and encompasses circular, irregular, polygonal and rectilinear shapes of nozzle. The term "circumscribing" or "circumscribes" as used herein is deemed to embrace not only a continuous nozzle surrounding the passage, but also a discontinuous nozzle having two or more nozzle outlets partially or entirely surrounding the passage.

The or each nozzle may be of a convergent-divergent geometry internally thereof, and in practice the nozzle is configured to give the supersonic flow of transport fluid within the passage. For a given, steam condition, i.e. dryness, pressure and temperature, the nozzle is preferably configured to provide the highest velocity steam jet, the lowest total pressure drop and the highest enthalpy between the steam chamber and nozzle exit.

The condensation profile in the mixing chamber determines the expansion ratio profile across the nozzle. With relatively low working fluid temperatures condensation is dominant, and the exit pressure of the transport fluid nozzle is low. The exit pressure of the transport fluid nozzle is higher when the bulk temperature of the working fluid is higher.

According to a third aspect of the present invention a method of moving a working fluid includes

- presenting a fluid mover to the working fluid, the mover having a straight-through passage of substantially constant cross section,
- applying a substantially circumscribing stream of a transport fluid to the passage through an annular nozzle,
- atomising the working fluid to form a dispersed vapour and droplet flow regime with locally supersonic flow conditions,
- generating a supersonic condensation shock wave within the passage downstream of the nozzle by condensation of the transport fluid,
- inducing flow of the working fluid through the passage from an inlet to an outlet thereof, and
- modulating the condensation shock wave to vary the working fluid discharge from the outlet.

Preferably the modulating step includes modulating the intensity of the condensation shock wave. Alternatively or additionally the modulating step includes modulating the position of the condensation shock wave.

The bore profile immediately upstream of the nozzle is preferably configured to encourage working fluid atomisation. Preferably an instability in working fluid flow is introduced immediately upstream of the nozzle.

The or each nozzle is preferably optimally configured to operate with a particular working fluid, upstream wall contour profile and mixing chamber geometry. The nozzles, upstream wall contour profile and mixing chamber combination are configured to encourage working fluid atomisation creating a vapour/droplet mixed flow with local supersonic flow conditions. This encourages the formation of the downstream condensation shock wave, by enhancing local turbulence, pressure gradient and the momentum and heat transfer rate between the transport and working fluids by maximising surface contact between the fluids.

The or each nozzle is preferably configured to operate with a particular working fluid, upstream wall contour profile and mixing chamber to provide an optimum nozzle exit pressure. Initial pressure recovery due to transport fluid deceleration, coupled with the downstream pressure drop due to condensation, is used to ensure the nozzle expansion ratio is adjusted to enhance atomisation of the working fluid and momentum transfer.

The exit velocity from the or each nozzle may be controlled by varying the transport fluid supply pressure, the expansion ratio of the nozzle and the condensation profile in the immediate region of the mixing chamber. The nozzle exit velocities may be controlled to enhance Momentum Flux Ratios M in the immediate region of the mixing chamber, where M is defined by the equation $$M \equiv \frac{(\rho_s \times U_s^2)}{(\rho_f \times U_f^2)}$$

where p=Fluid density

U'=Fluid velocity

Subscript s represents transport fluid

Subscript f represents working fluid

In the present invention it has been found that an optimum Momentum Flux Ratio M for the or each nozzle lies in the range $2 \leqq M \leqq 70$. For example, when using steam as the transport fluid, with a working fluid with a high water content, M for the or each nozzle lies in the range $5 \leqq M \leqq 40$.

The or each nozzle is configured to provide the desired combination of axial, radial and tangential velocity components. It is a combination of axial, radial and tangential components which influence the primary turbulent break-up (atomisation) of the working fluid flow and the pressure gradient.

The interaction between the transport fluid and the working fluid, leading to the atomisation of the working fluid, is enhanced by flow instability. Instability enhances the droplet stripping from the contact surface of the core flow of the working fluid. A turbulent dissipation layer between the transport and working fluids is both fluidically and mechanically (geometry) encouraged ensuring rapid fluid core dissipation. The pseudo-vena contracta is a resultant aspect of this droplet atomisation region.

The internal walls of the flow passage upstream of the or each nozzle may be contoured to provide a combination of axial, radial and tangential velocity components of the outer surface of the working fluid core when it comes into contact with the transport fluid. It is a combination of these velocity components which inter alia influence the primary turbulent break-up (atomisation) of the working fluid and the pressure gradient when it comes into contact with the transport fluid.

Under optimum operating conditions the disintegration or atomisation of the working fluid core is extremely rapid. The disintegration across the whole bore will typically take place in the mixing chamber within, but net limited to, a distance approximately equivalent to 0.66 D downstream of the nozzle exit. Under different non-optimised operating conditions disintegration across the whole bore of the mixing chamber, may still occur within, but not limited to, a distance equivalent to 1.5 D downstream of the nozzle exit, where D is the nominal diameter of the bore through the centre of the fluid mover.

Recirculation occurs in the flow. The recirculation is particularly dominant where tangential velocity components of the transport fluid are present. The radial pressure gradients created within the mixing chamber are responsible for this flow phenomenon which encourages complete and rapid flow dispersion characteristics across the bore.

This effect is also created when the pseudo-vena contracta is partially established, i.e. vapour-droplet flow is dominant along the mixing chamber boundary. The localised pressure gradient draws flow outwards, causing a region downstream of the transport fluid nozzle exit, typically between 1 diameter and 2 diameters downstream, where the axial flow component of the working fluid stagnates and may even reverse briefly on the centre-line, i.e. the centre of the flow region.

Recirculation has particular benefits in some applications such as emuisification.

A series of nozzles with respective mixing chamber sections associated therewith may be provided longitudinally of the passage and in this instance the nozzles may have different angular orientations, for example decreasing from the first nozzle in a downstream direction. Each nozzle may have a different function from the other or others, for example pumping, mixing, disintegrating or emulsifying, and may be selectively brought into operation in practice. Each nozzle may be configured to give the desired effects upon the working fluid. Further, in a multi-nozzle system by the introduction of the transport fluid, for example steam, phased heating may be achieved. This approach may be desirable to provide a gradual heating of the working fluid, enhanced atomisation, pressure gradient profiling or a combinatory effect, such as enhanced emuisification.

In addition the internal walls of the flow passage immediately upstream of the or each nozzle exit may be contoured to provide different degrees of turbulence to the working fluid prior to its interaction with the transport fluid issuing from the or each nozzle.

The mixing chamber geometry is determined by the desired and projected output performance and to match the designed transport fluid conditions and nozzle geometry. In this respect it will be appreciated that there is a combinatory effect as between the various geometric features and their effect on performance, namely there is interaction between the various design and performance parameters having due regard to the defined function of the fluid mover.

According to a fourth aspect of the present invention a method of processing a working fluid includes

- presenting a fluid mover to the working fluid, the fluid mover having a straight-through passage of substantially constant cross section,
- applying a substantially circumscribing stream of a transport fluid to the passage through an annular nozzle,
- atomising the working fluid to form a dispersed vapour and droplet flow regime with locally supersonic flow conditions,
- generating a supersonic condensation shock wave within the passage downstream of the nozzle by condensation of the transport fluid, the position of the condensation shock wave remaining substantially constant under equilibrium flow,
- inducing flow of the working fluid through the passage from an inlet to an outlet thereof, and changing the position of the condensation shock wave to vary the working fluid discharge from the outlet.

Changing the position of the condensation shock wave is preferably achieved by varying at least one of a group of parameters, the group of parameters including the inlet temperature of the working fluid, the flow rate of the working fluid, the inlet pressure of the working fluid, the outlet pressure of the working fluid, the flow rate of a fluid additive added to the working fluid, the inlet pressure of a fluid additive added to the working fluid, the outlet pressure of a fluid additive added to the working fluid, the temperature of a fluid additive added to the working fluid, the angle of entry of the transport fluid to the passage, the inlet temperature of the transport fluid, the flow rate of the transport fluid, the inlet pressure of the transport fluid, the internal dimensions of the passage downstream of the nozzle, and the internal dimensions of the passage upstream of the nozzle.

The term straight-through when used to describe a passage encompasses any passage having a clear flow path therethrough, including curved passages.

The fluid additive may be gaseous or liquid. The fluid additive is not an essential element of the invention, but in certain circumstances may be beneficial. The fluid additive may comprise a powder in dry form or suspended in a fluid.

The parameter varying step may include switching between a plurality of transport fluids or between a plurality of fluid additives.

The improvements of the present invention may be employed to the fluid mover of the aforementioned patent, and enhance its use in a variety of applications as disclosed in the aforementioned patent. These applications range from use as a fluid processor, including pumping, mixing, heating, homogenising etc, to marine propulsion, where the mover is submersed within a body of fluid, namely the sea or lake or other body of water. In its application to fluid processing a variety of working fluids may be processed and may include liquids, liquids with solids in suspension, slurries, sludges and the like. It is an advantage of the straight-through passage of the mover that it can accommodate material that might find its way into the passage.

The fluid mover of the present invention may also be used for enhanced mixing, dispersion or hydration and again the combination of the shearing mechanism, droplet formation and presence of the condensation shock wave provides the mechanism for achieving the desired result. In this connection the fluid mover may be used for mixing one or more fluids, one or more fluids and solids in particulate form, for example powders. The fluids may be in liquid or gaseous form. It has been found that the use of the present invention when mixing liquid with a powder of particulate form results in a homogeneous mixture, even when the powder is of material which is difficult to wet, for example Gum Tragacanth which is a thickening agent.

The treatment of the working fluid, for example heating, dosing, mixing, dispersing, emulsifying etc may occur in batch mode using at least one fluid mover or by way in an in-line or continuous configuration using one or more fluid movers as required.

A further use to which the present invention may be put is that of emuisification which is the formation of a suspension by mixing two or more liquids which are not soluble in each other, namely small droplets of one liquid (inner phase) are suspended in the other liquid(s) (outer phase). Emuisification may be achieved in the absence of surfactant blends, although they may be used if so desired. In addition, due to the straight through nature of the invention, there is no limitation on the particle size that can be handled, allowing particle sizes up to the bore size of the unit to pass through whilst emuisification is taking place.

The fluid mover may also be employed for disintegration, for example in the paper industry for disintegration of paper pulp. A typical example would be in paper recycling, where waste paper or broken pieces are mixed with water and passed through the fluid mover. A combination of the heat addition, the high intensity shearing mechanism, the low pressure region in the vapour-droplet flow and the condensation shock wave both rapidly hydrates the paper fibres, and macerates and disintegrates the paper pieces into smaller sizes. Disintegration down to individual fibres has been achieved in tests. Similarly, the fluid mover could be used in de-inking processes, where the heating and shearing assist in the removal of ink from paper pulp as it passes through the fluid mover.

The straight through aspect of the invention has the additional benefit of offering very little flow restriction and therefore a negligible pressure drop, when a fluid is moved through it. This is of particular importance in applications where the fluid mover is located in a process pipe work and fluid is pumped through it, such as the case, for example, when the fluid mover of the present invention is turned 'off' by the reduction or stopping of the supply of transport fluid. In addition, the straight through passage and clear bore offers no impedance to cleaning 'pigs' or other similar devices which may be employed to clean the pipe work.

A detailed description of the energy transfer mechanism, focussing on the momentum transfer between the transport fluid and working fluid by an enhanced shearing mechanism is best described with reference to the accompanying drawings. By way of example, eight embodiments of geometrical features that may be employed to enhance this energy transfer mechanism in accordance with the present invention are described below with reference to the accompanying drawings in which.

Like numerals of reference have been used for like parts throughout the specification.

Figure 1:
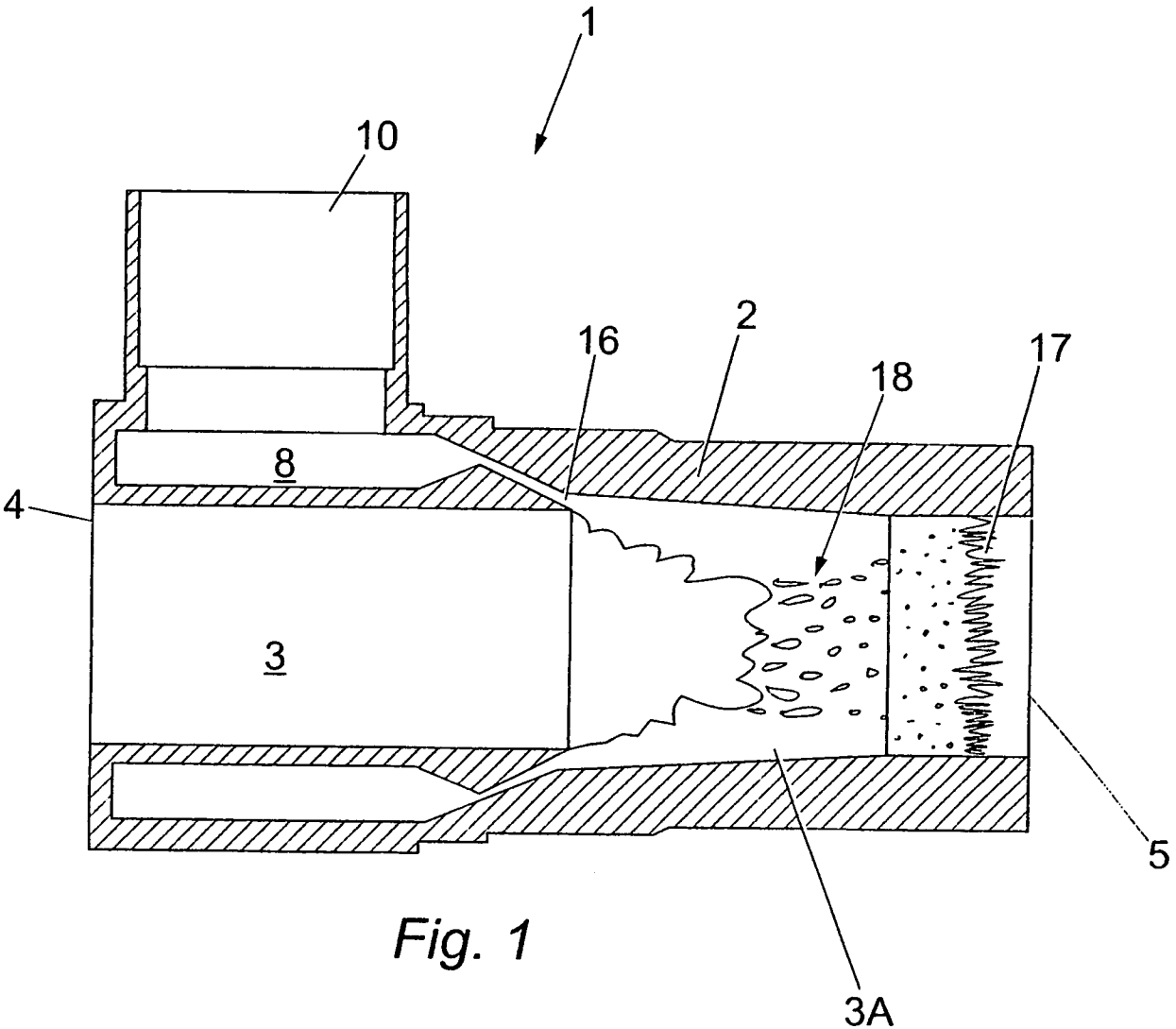
FIG. 1 is a cross sectional elevation of a fluid mover according to the present invention.

Referring to FIG. 1 there is shown a fluid mover 1, comprising a housing 2 defining a passage 3 providing an inlet 4 and an outlet 5, the passage 3 being of substantially constant circular cross section.

The housing 2 contains a plenum 8 for the introduction of a transport fluid, the plenum 3 being provided with an inlet 10. The distal end of the plenum is tapered on and defines an annular nozzle 16. The nozzle 16 being in flow communication with the plenum 8. The nozzle 16 is so shaped as in use to give supersonic flow.

In operation the inlet 4 is connected to a source of a process or working fluid. Introduction of the steam into the fluid mover 1 through the inlet 10 and plenum 8 causes a jet of steam to issue forth through the nozzle 16. Steam issuing from the nozzle 16 interacts with the working fluid in a section of the passage operating as a mixing chamber (3A). In operation the condensation shock wave 17 is created in the mixing chamber (3A).

In operation the steam jet issuing from the nozzle occasions induction of the working fluid through the passage 3 which because of its straight through axial path and lack of any constrictions provides a substantially constant dimension bore which presents no obstacle to the flow. At some point determined by the steam and geometric conditions, and the rate of heat and mass transfer, the steam condenses causing a reduction in pressure. The steam condensation begins shortly before the condensation shock wave and increases exponentially, ultimately forming the condensation shock wave 17 itself.

The low pressure created shortly before and within the initial phase of the condensation shock wave results in a strong fluid induction through the passage 3. The pressure rises rapidly within and after the condensation shock wave. The condensation shock wave therefore represents a distinct pressure boundary/gradient.

The parametric characteristics of the steam coupled with the geometric features of the nozzle, upstream wall profile and mixing chamber are selected for optimum energy transfer from the steam to the working fluid. The first energy transfer mechanism is momentum and mass transfer which results in atomisation of the working fluid. This energy transfer mechanism is enhanced through turbulence.

FIG. 1 shows diagrammaticaily the break-up, or atomisation sequence 13 of the working fluid core.

Figure 2:
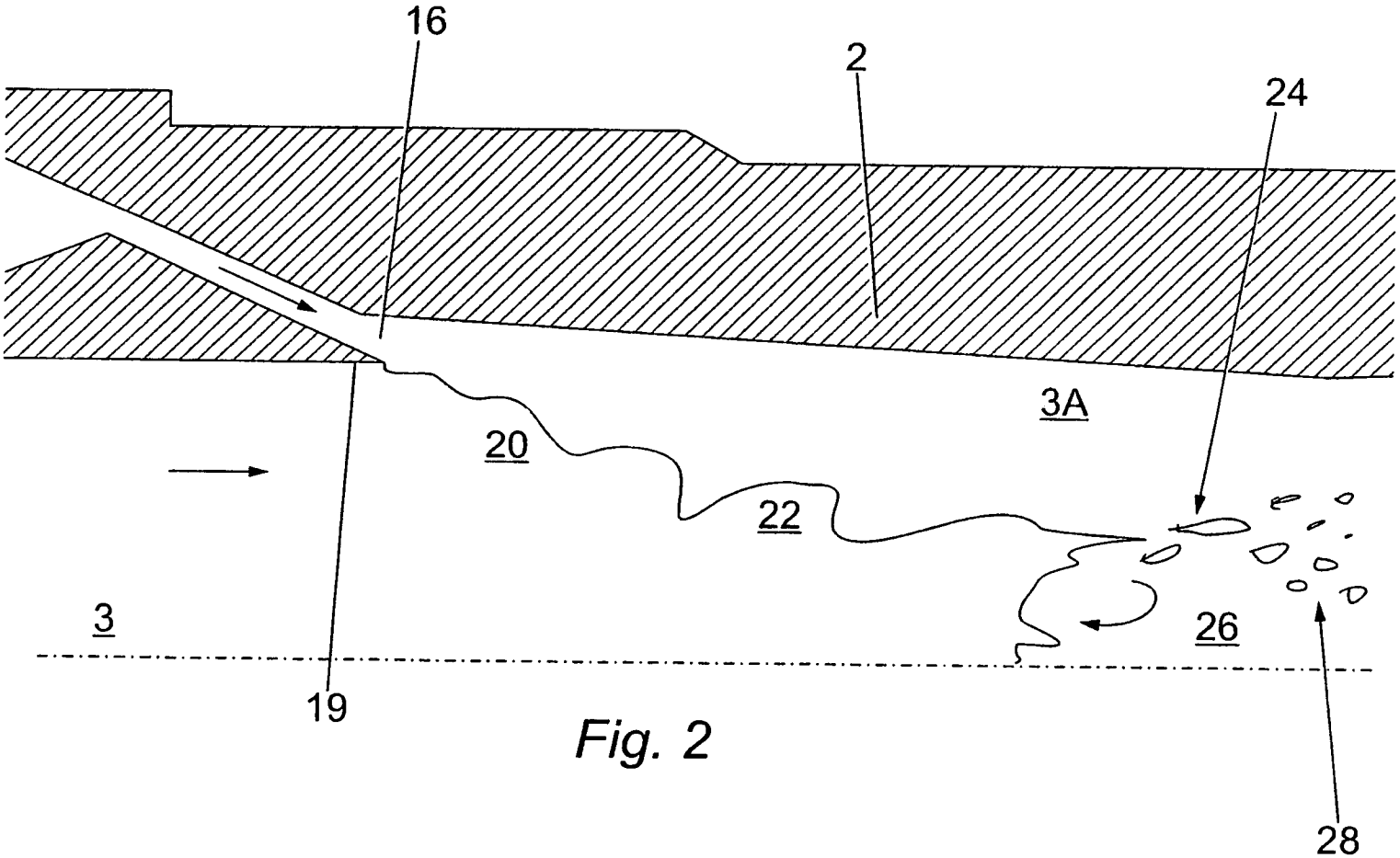
FIG. 2 is a magnified view of the shearing mechanism shown in FIG. 1.

FIG. 2 shows a magnified and exaggerated schematic of the shearing and atomisation mechanism 13 of the working fluid by the transport fluid. It is believed that this mechanism can be broken down into three distinct regions, each governed by established turbulence mechanisms. The first region 20 experiences the first interaction between the transport and working fluid. It is in this region that Kelvin-Helmholtz instabilities in the surface contact layer of the working fluid may start to develop. These instabilities grow due to the shear conditions, pressure gradients and velocity fluctuations, leading to Rayleigh-Taylor ligament break-up 24. Second order eddies within the fluid surface waves may reduce in size to the scale of Kolmogorov eddies 22. It is believed that the formation of these eddies, in association with the Rayleigh-Taylor ligament break-up, result in the formation of small droplets 28 of the working fluid.

The droplet formation phases may also result in a localised recirculation zone 26 immediately following the ligament break-up region. This recirculation zone may enhance the fluid atomisation further by re-circulating the larger droplets back into the high shear region. This recirculation, a feature of the localised pressure gradient, is controllable via the transport fluid's axial, tangential and radial velocity and pressure components. It is believed that this mechanism enhances inter alia, the mixing, emulsifying and pumping capabilities of the fluid mover.

The primary break-up mechanism of the working fluid core may therefore be enhanced by creating initial instabilities in the working fluid flow. Deliberately created instabilities in the transport fluid/working fluid interaction layer encourage fluid surface turbulent dissipation resulting in the working fluid core dispersing into a liquid-ligament region, followed by a ligament-droplet region where the ligaments and droplets are still subject to disintegration due to aerodynamic characteristics.

Figure 3:
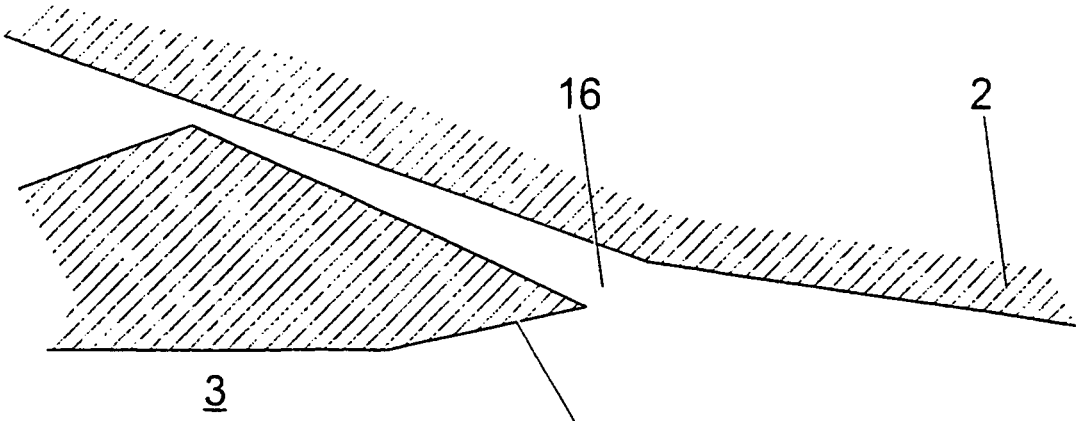
FIG. 3 is a cross sectional elevation of a first embodiment.

Referring now to FIG. 3 the fluid mover of FIGS. 1 and 2 is provided with a contoured internal wall in the region 19 immediately upstream of the exit of the steam nozzle 16. The internal wall of the flow passage 3 immediately upstream of the nozzle 16 is provided with a tapering wall 30 to provide a diverging profile leading up to the exit of the steam nozzle 16. The diverging wall geometry provides a deceleration of the localised flow, providing disruption to the boundary layer flow, in addition to an adverse pressure gradient, which in turn leads to the generation and propagation of turbulence in this part of the working fluid flow. As this turbulence is created immediately prior to the interaction between the working fluid and the transport fluid, the instabilities initiated in these regions enhance the Kelvin-Helmholtz instabilities and hence ligament and droplet formation as foreshadowed in the foregoing description occurs more rapidly.

Figure 4:
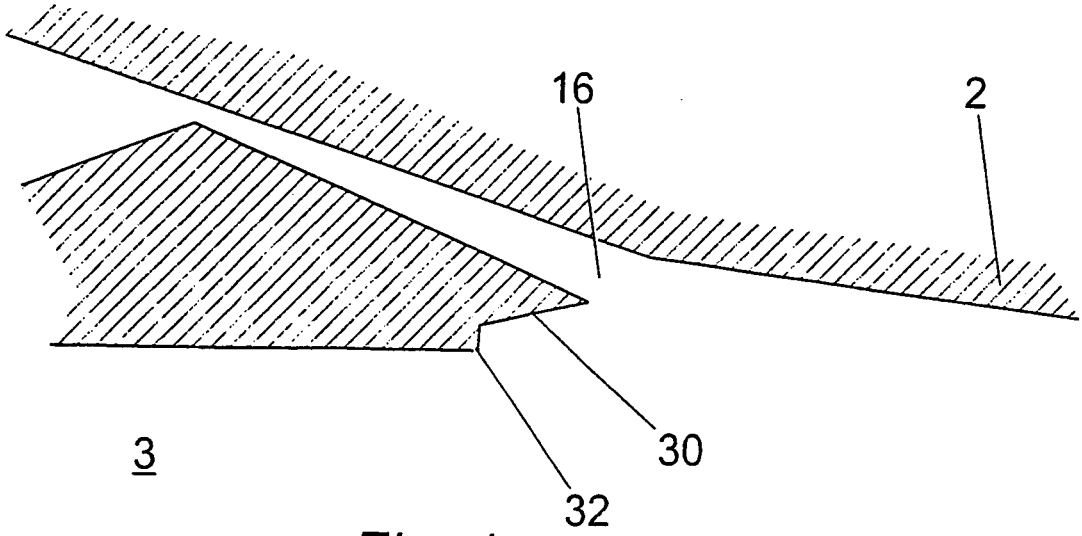
FIG. 4 is a cross sectional elevation of a second embodiment.

An alternative embodiment is shown in FIG. 4. Again, the fluid mover of FIGS. 1 and 2 is provided with a contoured internal wail 19 of the flow passage 3 immediately upstream of the nozzle 16. The contoured surface in this embodiment is provided by a diverging wall 30 on the bore surface leading up to the exit of the steam nozzle 16, but the taper is preceded with a step 32. In use, the step results in a sudden increase in the bore diameter prior to the tapered section. The step 'trips' the flow, leading to eddies and turbulent flow in the working fluid within the diverging section, immediately prior to its interaction with the steam issuing from the steam nozzle 16. These eddies enhance the initial wave instabilities which lead to ligament formation and rapid fluid cone dispersion.

The tapered diverging section 30 could be tapered over a range of angles and may be parallel with the walls of the bore. It is even envisaged that the tapered section 30 may be tapered to provide a converging geometry, with the taper reducing to a diameter at its intersection with the steam nozzle 16 which is preferably not less than the bore diameter.

The embodiment shown in FIG. 4 is illustrated with the initial step 32 angled at 90° to the axis of the bore 3. As an alternative to this configuration, the angle of the step 32 may display a shallower or greater angle suitable to provide a 'trip' to the flow. Again, the diverging section 30 could be tapered at different angles and may even be parallel to the walls of the bore 3. Alternatively, the tapered section 30 may be tapered to provide a converging geometry, with the taper reducing to a diameter at its intersection with the steam nozzle 16 which is preferably not less than the bore diameter.

FIGS. 5 to 8 illustrate examples of alternative contoured profiles. All of these are intended to create turbulence in the working fluid flow immediately prior to the interaction with the transport fluid issuing from the nozzle 16.

Figure 5:
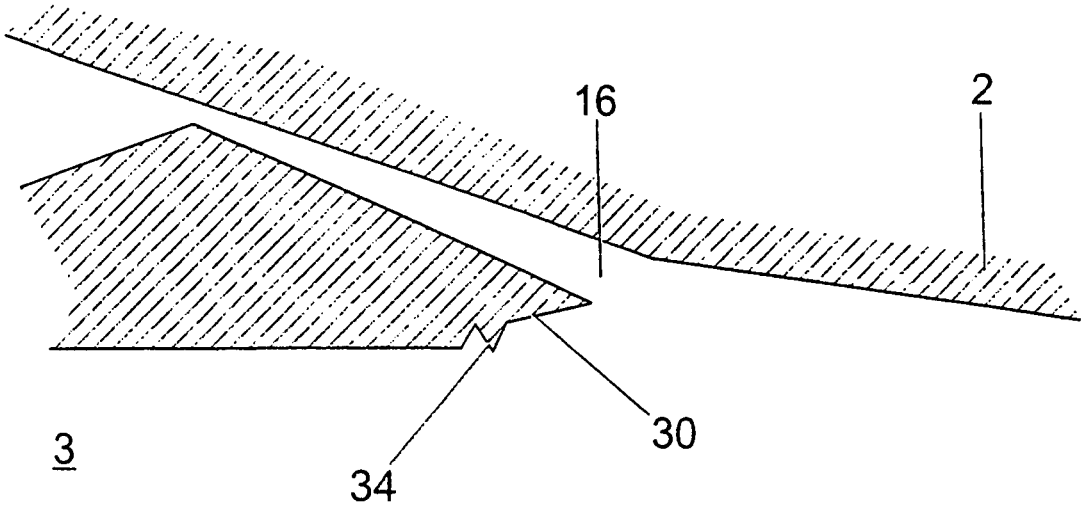
FIG. 5 is a cross sectional elevation of a third embodiment.
Figure 6:
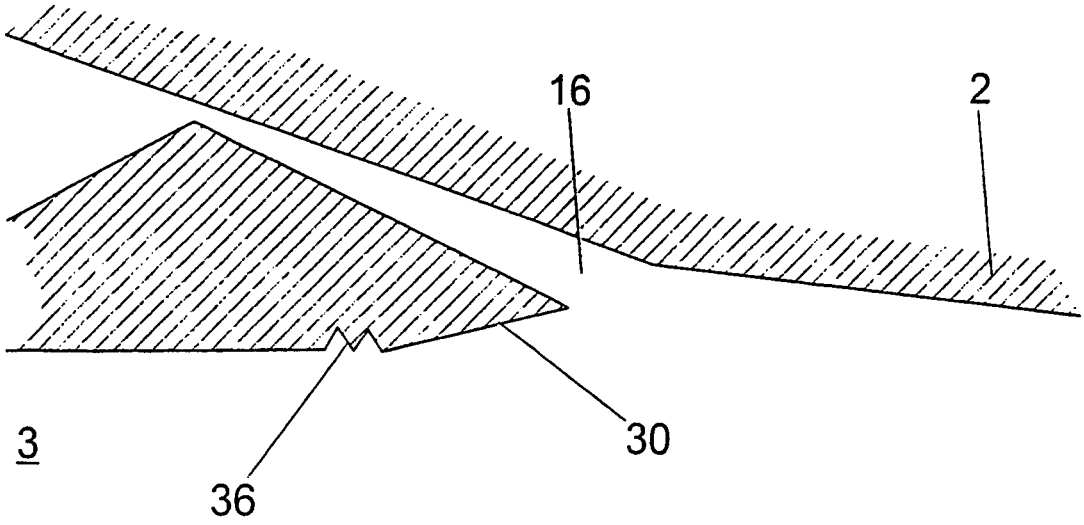
FIG. 6 is a cross sectional elevation of a fourth embodiment.

The embodiments illustrated in FIGS. 5 and 6 incorporate single or multiple triangular cross section grooves 34, 36 immediately prior to a tapered or parallel section 30, which is in turn immediately prior to the exit of the steam nozzle 16.

Figure 7:
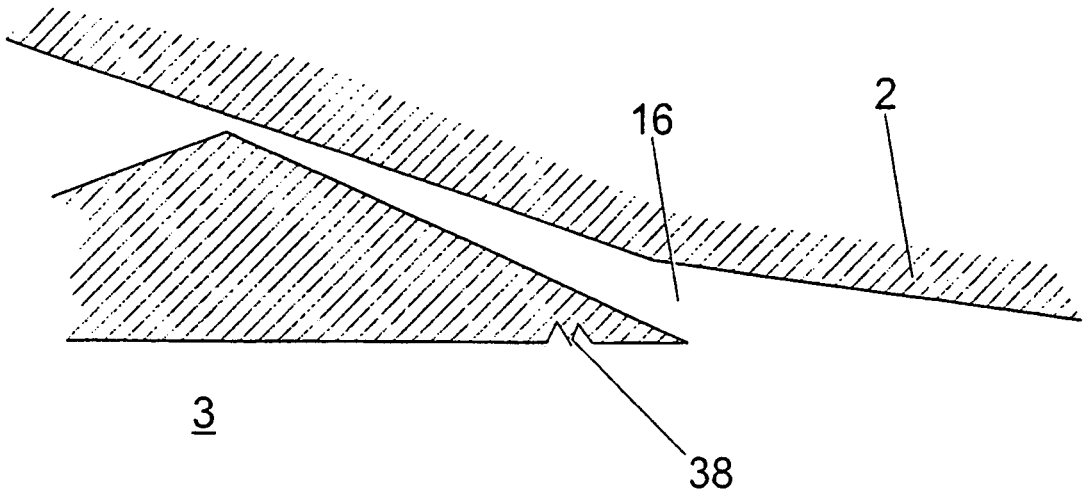
FIG. 7 is a cross sectional elevation of a fifth embodiment.
Figure 8:
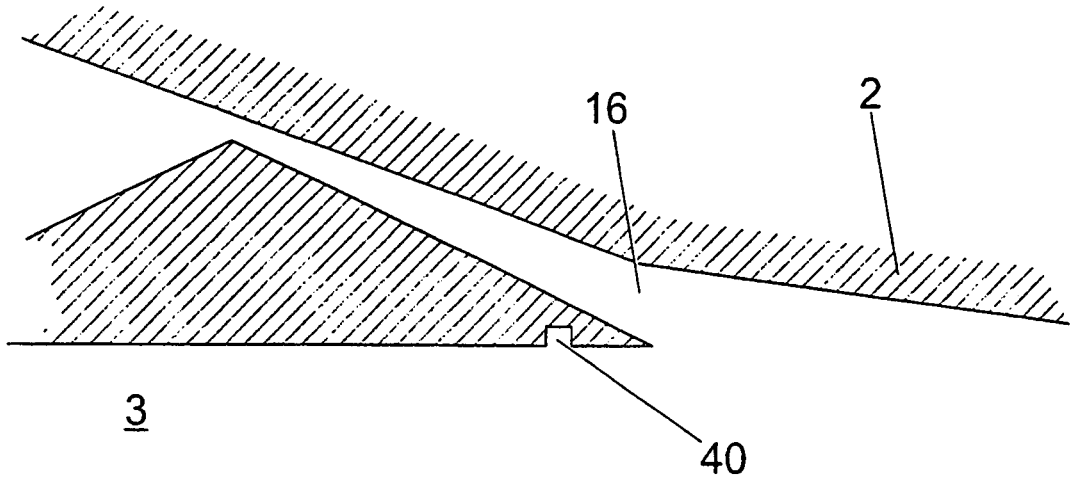
FIG. 8 is a cross sectional elevation of a sixth embodiment.

The embodiments illustrated in FIGS. 7 and 8 incorporate single or multiple triangular 38 and/or square 40 cross section grooves a short distance upstream of the exit of the steam nozzle 16. These embodiments are illustrated without a tapering diverging section after the grooves.

Although FIGS. 1 to 8 illustrate several combinations of grooves and tapering sections, it is envisaged that any combination of these features, or any other groove cross-sectional shape may be employed.

The tapered section 30 and/or the step 32 and/or the grooves 34, 36, 38, 40 may be continuous or discontinuous in nature around the bore. For example, a series of tapers and/or grooves and/or steps may be arranged around the circumference of the bore in a segmented or 'saw tooth' arrangement.

Figure 10:
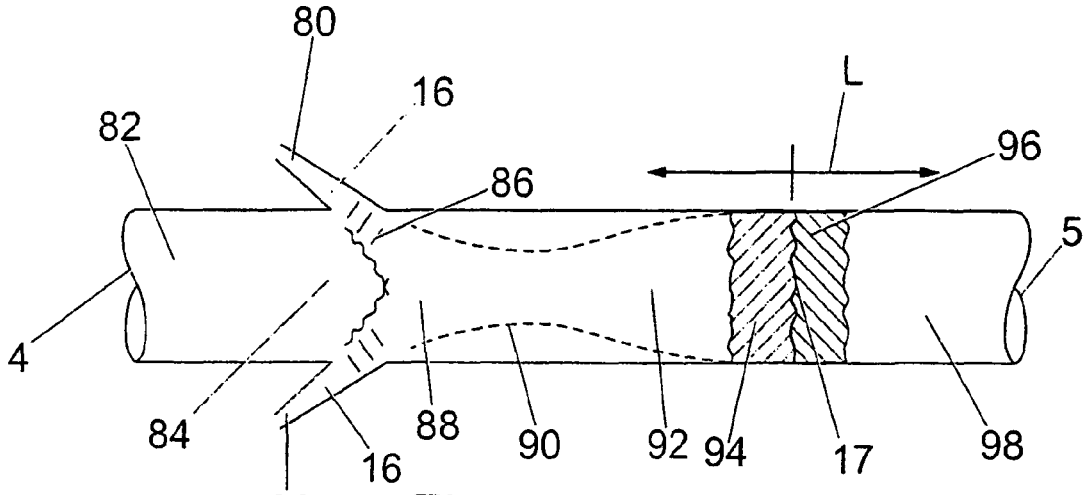
FIG. 10 is a schematic section through the fluid regime of the fluid mover of the present invention.

The nature of the flow regime in the fluid mover of the present invention is described in more detail below, with reference to FIG. 10.

The transport fluid, usually steam 80, enters through nozzle 16 at supersonic velocity. Wherever the term steam is used, it is to be understood that the term can also be applied to other transport fluids. The working fluid, usually liquid 82, flows at a subsonic velocity into the inlet 4. At the nozzle 16 there is a subsonic liquid core 84 which is bounded by a generally rough or turbulent conical interface with the steam 80 and the region of dispersion 88. As the steam 80 exits the nozzle 16 it exhibits local shock and expansion waves 86 and forms a pseudo vena contracta 90. The accelerated region of dispersion 88 (or dissociation) of the liquid core flows at a locally supersonic velocity into the vapour-droplet region 92, in which the vapour is steam and the droplets are the working fluid. Condensation takes place in the supersonic condensation zone 94 and the subsonic condensation zone 96. The condensation shock wave 17 is produced when the condensation, which initiates in the locally supersonic low density region 94, reaches an exponential rate. The zone 96 immediately after the condensation shock wave 17 has a considerably higher density and is hence subsonic. The condensation shock wave 17 thus defines the interface between these two densities.

In the liquid phase 98 beyond the condensation zone 96 there are small vapour bubbles. The position of the condensation shock wave is controllable over a distance L by adjustment of one of the plurality of parameters described herein.

The break-up and dispersion of the primary liquid core produces a droplet vapour region. Any liquid instabilities on the primary liquid cone surface 18 are amplified to form 'waves'. These waves are further elongated to form ligaments that undergo Rayleigh-Taylor break-up, resulting in the formation of small droplets 28, separated ligaments 24 and larger droplets.

The secondary region 24 is thus characterised by the rapid increase in the effective fluid surface area. These droplets 28, of varying size, are then subject to several aerodynamic and thermal effects which ultimately result in their break up to sizes characteristic with the turbulence levels in this region. This results in the vapour-droplet region which defines the flow regime within the fluid mover.

The thickness of the viscous sub layer, comprising the high speed vapour/gas and the locally entrained liquid in droplet or ligament form, increases downstream to ultimately extend across the entire bore. The turbulence within this region arises from shear (velocity gradient) and eddies (large scale to Kolmogorov scale), as the flow is essentially of a vapour-droplet consistency. High levels of shear exist in the gas/liquid interface.

A large amount of energy is transferred in this secondary region 24 as a result of further particle break-up. Mass transfer takes place as the shear forces and thermal discontinuities result in the droplets becoming ever smaller. The pressure reduces and droplets are evaporated in order to maintain equilibrium in the flow. Heat transfer takes place as equilibrium conditions are reached, ensuring that liquid vapour phase transitions and the inverse transitions all occur within the mixing section of the passage 3. In the secondary region there is a very rapid increase in the void fraction $$\alpha = \frac{A_g}{A_{Tot}}$$

where $\alpha$=void fraction $A_g$=area of gas phase (dispersion cone)

$A_{Tot}$=total area of pump flow

Thus the rapid increase in specific volume as the liquid droplets/ligaments are further dispersed, will obviously result in a larger void fraction. Subsequently as the flow conditions begin to approach a state of equilibrium, and due to the geometry within the mixing chamber, the vapour flew is encouraged to follow a condensation profile towards an aerodynamic and condensation shock wave, which is a region of non-equilibrium and entropy production.

The condensation shock wave arises from the rapid change from a two-phase fluid mixture to a substantially single phase fluid with complete condensation of the vapour phase. Since there is no unique sonic speed in vapour droplet mixtures, non-equilibrium and equilibrium exchanges of momentum, mass and energy can occur. In order to achieve a normal condensation shock wave, the velocity of the vapour mixture within the mixing chamber has to be maintained above a certain value defined as the equilibrium sonic speed. For conditions where the vapour velocity is greater than the frozen sonic speed, or where the velocity of the vapour mixture is between the equilibrium and frozen sonic speed, this results in a dispersed or partially dispersed condensation shock wave. These two asymptotic sonic speeds are:

$a_e$=equilibrium shock speed. This is the speed at which every fluid is in its correct equilibrium condition, i.e. vapour is vapour, liquid is liquid $a_f$=frozen shock speed. This occurs primarily due to a 'lag' effect, so that some fluids are not in their correct phase, for example the local temperature and pressure dictate that a vapour should be turning to liquid, but the phase change has not happened.

$a_f$ and $a_e$ are defined as:

$$a_f = \sqrt{\gamma \cdot R_v \cdot T_s}$$

$$a_e = \sqrt{\frac{\chi \cdot \gamma \cdot R_v \cdot T_s}{\gamma\left[1 - \frac{R_v \cdot T_s}{h_{fg}}\left(2 - \frac{c \cdot T_s}{h_{fg}}\right)\right]}}$$

where $$c = Cp_v + \frac{\left(\frac{1-\varepsilon}{\varepsilon}\right)}{Cp_f}$$

Y=Ratio of specific heats (the vapour and the fluid)

$R_v$=Gas constant for vapour phase (steam)

$T_s$=Saturation temperature of mixture (vapour and fluid)

Cp=Specific heat $H_{fs}$=Latent heat of vapourisation $\chi$=Initial vapour quality $\epsilon$=Vapour fraction (gas/liquid)

Subscript v, represents vapour (steam)

Subscript f, represents fluid (e.g. liquid)

Frozen flow arises when the interface transport of mass, momentum and energy between the vapour phase and liquid droplets is frozen completely, i.e. the liquid droplets do not take part in the fluid mechanical processes.

Equilibrium flow arises when the velocity and temperature of the vapour and liquid are in equilibrium, and the partial pressure due to the vapour is equal to the saturation pressure corresponding to the temperature of the flow.

The secondary flow regime can better be understood by further subdivision into three sub-regions.

The first sub-region of the secondary flow regime is the droplet break-up sub-region. Just as in the primary zone, where the liquid core is stripped to form the droplet-vapour zone, with the stripping of the ligaments and droplets on the surface, so in the secondary region there is further break-up or dispersion of these separated ligaments, and also the break-up of droplets whose characteristics are unstable in the turbulent flow regime. The dominant mechanism responsible for the break-up in the secondary region is the acceleration of droplets or momentum transfer due to the slip velocity between vapour and liquid. The injection velocity of the vapour in the present invention is important to this functional aspect of the flew regime. If required, multiple nozzles staggered downstream may be used to encourage this aspect. Other parameters such as nozzle angle and mixing chamber geometry can be selected to establish favourable flow conditions.

Typical break-up mechanisms in this region are dependant on the local velocity slip conditions and the respective working fluid properties. These are gathered into a dimensionless number referred to as the aerodynamic Weber number defined as:

$$We = \frac{\rho_v \cdot (U_f - U_v)^2 \cdot D_f}{\sigma_f}$$

where $\rho_v$=Density of vapour

U=Velocity $D_f$=Hydraulic diameter of fluid $\sigma_f$=Surface tension of fluid Typical break-up mechanisms found in the fluid mover of the present invention are vibrational break-up, which can be found with ligaments and droplets whose characteristic length is greater than the stable length; catastrophic break-up, which is especially dominant in the liquid-vapour shear layer where We≧350; wave crest stripping, which occurs where droplets, due to their size, experience large aerodynamic forces causing ellipsoidal shapes, typically where We≧300; and short stripping, which is the dominant break-up mechanism where daughter and satellite droplets have been formed following the ligament stripping and dispersion, typically where We≧100.

The turbulent motion of the surrounding gas, especially where the Reynold numbers are large ($Re>10^4$), as is usually the case in the present invention, results in large amounts in local energy dissipation and accompanying droplet break-up. The fluctuating dynamic pressures resulting from these turbulent fluctuations are dominant in droplet break-up but very importantly it is this energy that ensures extremely effective dispersion and mixing of the fluids in the flow.

Turbulent pressure fluctuations result in shear forces capable of rupturing fibres or filaments and dissipating powder lumps or similar solid or semi-solid matter. In the primary region energy, mass and momentum transfer takes place through a more distinct boundary, associated with the liquid cone dispersion. In the secondary break-up region this transfer is directly related to the turbulence intensity, closely associated with the turbulent dissipation region in the flow.

The thermal boundary layer, although similar in characteristic to the turbulent dissipation sublayer, represents the effective boundary where evaporation/condensation and energy transfer occur in either an equilibrium state or 'frozen' state.

Interfacial transport, which begins within the primary cone dissipation, continues into the secondary vapour-droplet region and is characterised by distinct mechanisms enhanced within the fluid mover of the invention through vapour introduction conditions, dependent on pressure and velocity, the physical geometry of the steam nozzles and the mixing chamber geometry. This results in a continuous surface renewal process, which together with the turbulence results in a series of renewed eddies of various scales. These eddies create bursts arising from the interface of the liquid vapour and the waves formed on ligaments and droplets which are undergoing further break-up. These bursts have a period which is a function of the interfacial shear velocity. These bursts greatly encourage mixing, heat transport and emuisification (droplet size reduction).

The second sub-region of the secondary flow regime is the subcooled vapour-droplet region. As the vapour mixture flows through the fluid mover of the invention its velocity profile is adjusted through fluidic interaction as well as the static pressure gradient which gradually rises due to general deceleration of the flow. This controlled diffusion of the supersonic flow, balance of natural fluidic and thermodynamic interactions coupled with discrete geometry results in a vapour-droplet state where sub-cooled droplets exist within a vapour dominant phase. The sub-cooled state of this frozen mixture increases until droplet nucleation, and hence condensation, begins to occur very rapidly. The point of maximum sub-cooling (Wilson point) determines the point at which the nucleation rate, which is closely dependent on sub-cooling because of the available surface area for condensation, begins to occur very rapidly, and reaches near exponential rates. The vapour-droplet region within the fluid mover of the invention thus is able to attain near thermodynamic equilibrium within a very short zone.

The fluid mover of the invention makes special use of geometric conditions created through both geometry and pseudo geometric conditions to ensure the flow conditions upstream of the critical subcooled state deviate from the thermodynamic equilibrium. This ensures maintenance of the desired vapour-droplet region with its desirable droplet break-up, particle dispersion and heat transfer effects.

The rapid acceleration of the fluid from the primary fluid cone into the vapour region results in an expansion wave, which similarly represents a thermodynamic discontinuity and allows the vapour droplet region to deviate markedly from equilibrium and enter a 'frozen' flow condition.

Figure 9:
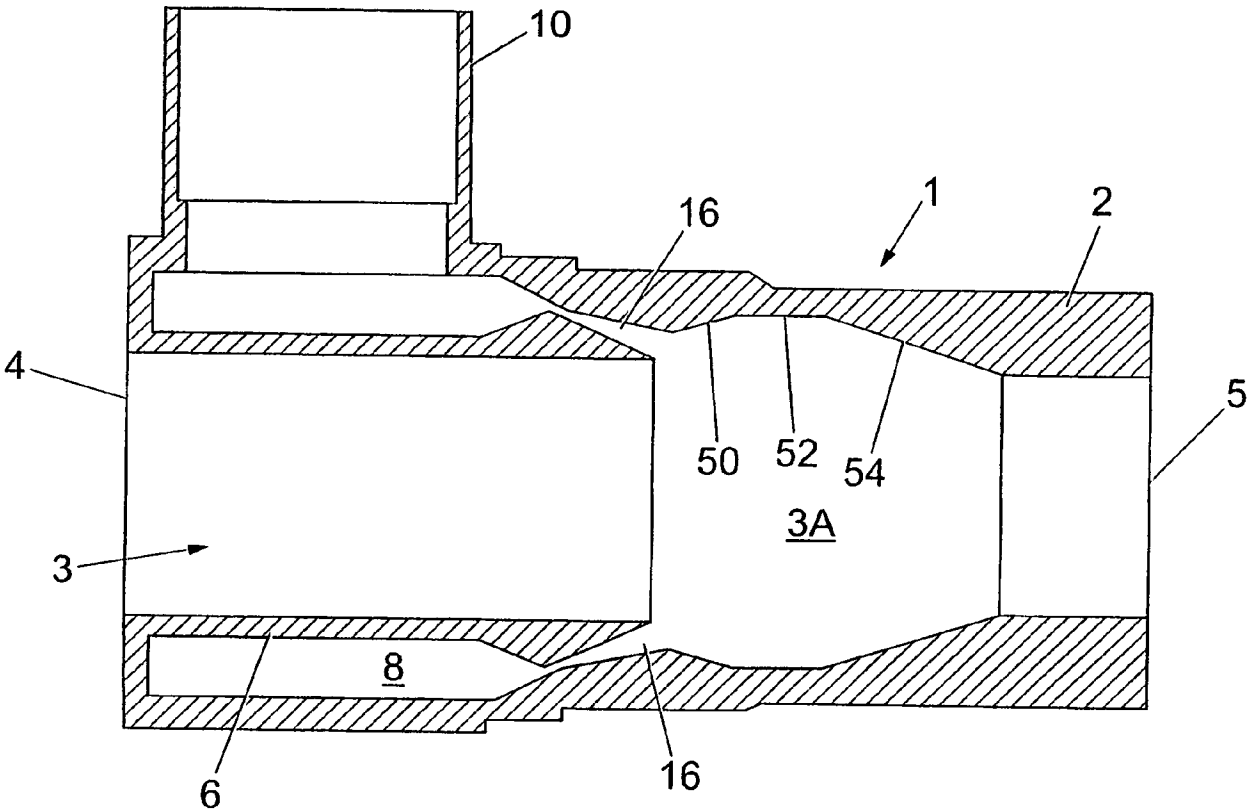
FIG. 9 is a cross sectional elevation of a seventh embodiment.

FIG. 9 shows an embodiment of the fluid mover of the invention in which the geometry of the passage 3 has a mixing chamber 3A with a divergent region 50, a constant diameter region 52 and a re-convergence profile region 54. The constant through bore is maintained, but the embodiment of FIG. 9 promotes this expansion and non-equilibrium. This offers excellent particle dispersion, and good flow, pressure head and suction conditions.

The third sub-region of the secondary flow regime is the condensation shock region. As a result of the sub-cooled vapour-droplet flow regime within the fluid mover, the point at which exponential condensation begins to occur defines the condensation shock wave boundary. The mixture conditions upstream of the condensation shock wave determine the nature of the pressure and temperature recovery experienced within the fluid mover.

The phase change across the condensation shock wave obviously results in heat removal from the vapour phase, although there will be an entropy increase across the condensation shock wave. The ideal operating conditions in the fluid mover of the invention coincide with the formation of a normal condensation shock wave, referred to as being discrete, due to its relatively rapid and hence negligible size measured along the X-axis.

The nature of the fluid flow in the fluid mover of the present invention may better be understood by reference to FIG. 12, which shows the distribution of pressure p in the fluid mover over length x along the axis. Reference is made to the two shock speeds, $a_e$ and $a_f$, defined earlier.

Figure 12A:
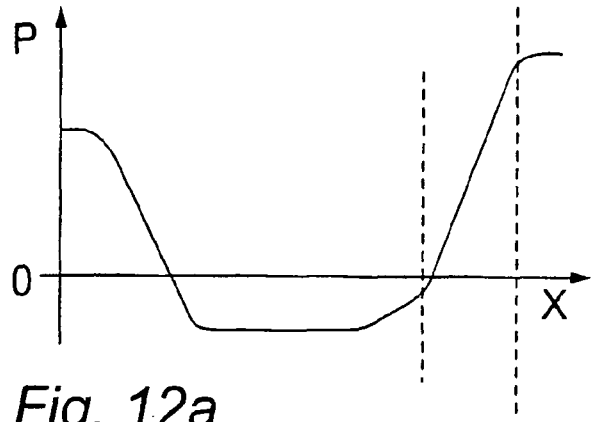
FIG. 12 is a schematic drawing showing pressure in the fluid mover of the present invention under three different operating conditions.

FIG. 12*a* shows condition A and represents the situation where $U_{mixture}>a_e$, where $U_{mixture}$ is the velocity of the vapour/droplet mixture.

This results in a normal condensation shock wave, with a fairly rapid rise in pressure across the condensation shock wave. The resulting exit pressure is higher than the local pressure at the steam inlet into the bore of the fluid mover.

Figure 12B:
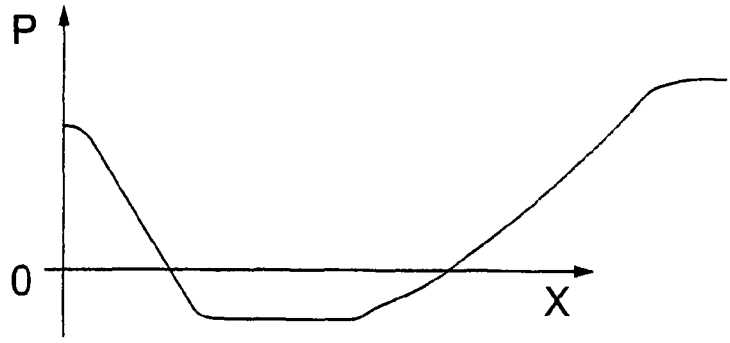

FIG. 12*b* shows condition B and represents the situation where $a_f>U_{mixture}>a_e$. In this case the mixture velocity is higher than the equilibrium shock speed but less than the frozen shock speed. In this condition the condensation shoe k wave is fully dispersed resulting in a much more gradual pressure rise across the condensation shock wave.

Figure 12C:
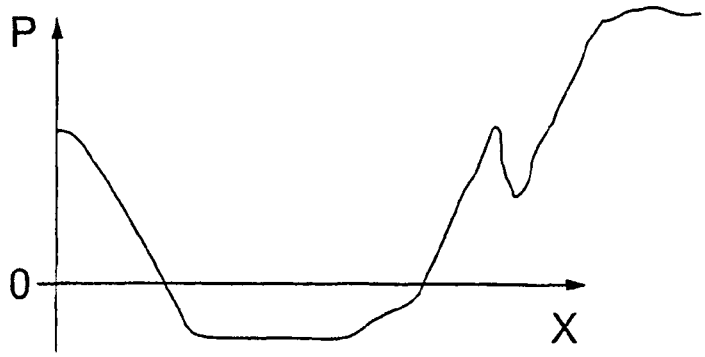

FIG. 12*c* shows condition C and represents the situation where $U_{mixture}>a_f$. In this condition an 'unstable' condition arises, with the steam not fully condensing. This is referred to as a partially dispersed condensation shock wave. This results in the start of the formation of a condensation shock wave (with a reasonably steep pressure gradient), the condensation shock wave formation 'stalling', and then restarting again. However, it has been found that the final resulting exit pressure is often higher than for either Condition A or Condition B.

There are several mechanisms for determining the state of the flow regime in the fluid mover, and using this information in a control system to provide the flow regime that best meets the demands of the application. For example one can measure the temperature at a particular point along the length of the mixing chamber, to determine the existence of a vapour-droplet region. Such a method is non-intrusive since the mixer wall can be of thin section allowing a rapid response to the change in conditions. Multiple temperature probes spaced downstream of one another can be used to monitor the position of the condensation shock wave, as well as to determine the state of the condensation shock wave profile.

As a further example the use of pressure sensors allows the condensation shock wave position to be determined.

Figure 13:
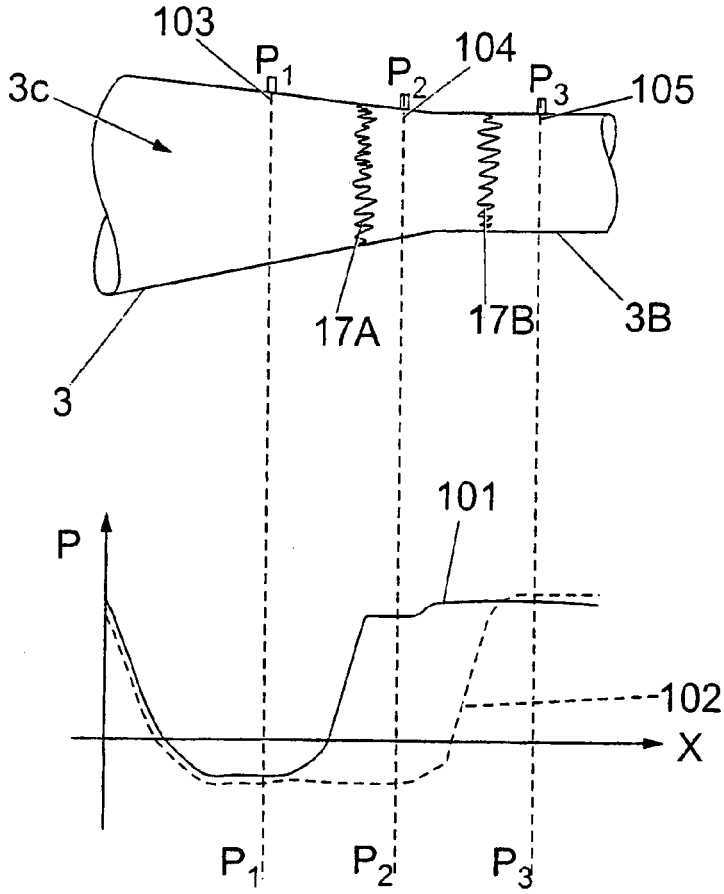
FIG. 13 is a schematic drawing showing a section through the fluid mover of the present invention and the pressure distribution in the fluid mover under two different condensation shock wave positions.

With reference to FIGS. 13 and 14 there is shown a method of using a series of pressure sensors to detect the position of the condensation shock wave in the mixing chamber. When the condensation shock wave 17 is in the position 17A indicated by Case 1, i.e. in the convergent profile portion 3C of the passage 3, the pressure profile is shown with the reference numeral 101. When the condensation shock wave 17 is in the position 17B indicated by Case 2, i.e. in the uniform profile portion 3B of the passage 3, the pressure profile is shown with the reference numeral 102. Pressure sensors P1, P2 and P3 in the passage 3 can be used to measure the pressure at three points 103, 104, 105 along the passage. The pressure measurements at these points can be used to determine the position of the condensation shock wave 17. Depending on the flow profile required, one or more parameters, as described hereinbefore, can be changed to alter the flow profile and the position of the condensation shock wave 17.

Figure 14A:
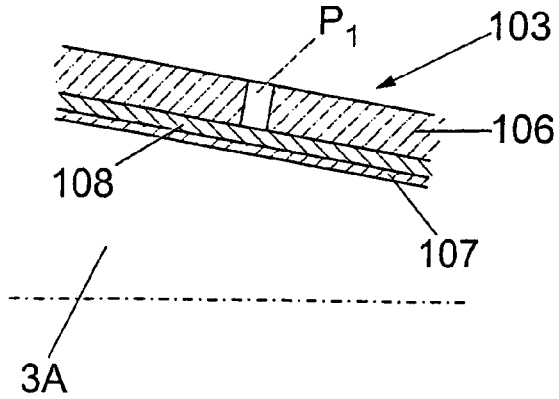
FIGS. 14*a* and 14*b* are partial cross sectional views through an eighth embodiment of the fluid mover of the present invention.

FIG. 14*a* shows a typical pressure sensor, although it is to be understood that this is not limiting, and any suitable pressure sensor or measuring device may be used. This method of measuring pressures in the mixing chamber is especially suited for condensation shock wave detection, since the measurement technique only needs to measure a change in pressure rather than being calibrated to measure accurate values.

The mixing chamber 3A is sleeved with a thin walled inner sleeve 107 of suitable material, such as stainless steel. A thin layer of oil 108 fills the gap between the sleeve 107 and the inner wall 106 of the mixing chamber 3A. The pressure sensor P1 is located through the wall 106 of the mixing chamber and is in contact with the oil 108. When the pressure inside the mixing chamber 3A changes, the sleeve 107 expands or contracts a small amount, thereby increasing or decreasing the pressure in the oil 108, which is then detected by the pressure sensor P1.

Figure 14B:
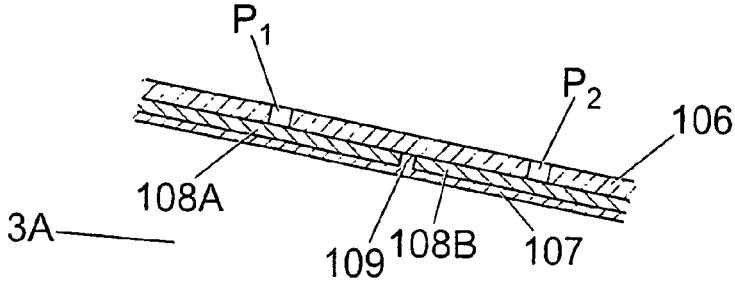

In the embodiment of FIG. 14*b* the sleeve 107 is segmented so that the oil is separated by walls 109 fixed to the sleeve. This results in separate individual chambers of oil 108A, 108B, each with their own pressure sensor P1, P2. A number of separate chambers and pressure sensors may be arranged along the wall 106 of the mixing chamber 3A.

The advantage of this instrumentation method is that the sleeve 107 provides a clean inner bore, free of any crevices or other features in which working fluid or other transported material can become trapped. This is of particular relevance for use in the food industry. In addition, the pressure sensor P1 is free from contamination, suffers no wear or abrasion, and does not become blocked.

A further possible way of monitoring the condensation shock wave is by the use of acoustic signatures. Due to the density variation in the mixer, even during powder addition, it is possible to determine the 'state' of flow which is an indication of vapour flow, and hence the condition of having a condensation shock wave. The mechanisms for determining the state of the flow regime in the fluid mover may of course be combined.

Figure 11:
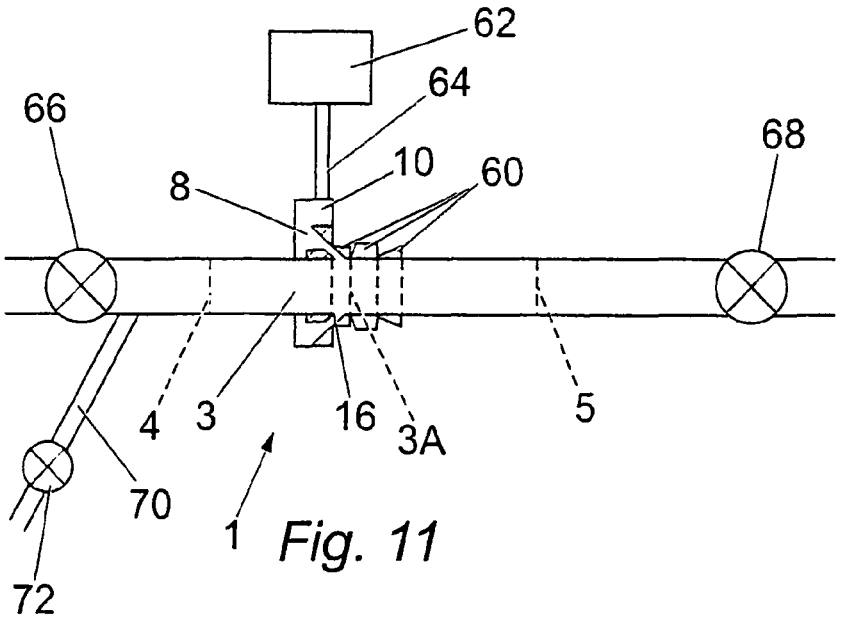
FIG. 11 is a schematic drawing of the fluid mover of the present invention in use.

FIG. 11 shows an embodiment of the fluid mover 1 with various control means for controlling the parameters of the flow. The inlet 4 is in fluid communication with a working fluid valve 66 which can be used to control the flow rate and/or inlet pressure of the working fluid. A heating means or cooling means (not shown) may be provided upstream or downstream of the valve 66 to control the inlet temperature of the working fluid. The outlet 5 is in fluid communication with an optional working fluid outlet valve 68 which can be used to control the outlet pressure of the working fluid.

A transport fluid source 62, such as a steam generator, is controllable to provide transport fluid through the transport passage 64 to the plenum 8. The source 62 can be used to control the inlet temperature and/or the flow rate and/or the inlet pressure of the transport fluid.

The nozzle or nozzles 16 may be mounted for adjustable movement such that a nozzle angle control means (not shown) can be used to control the angle of entry of the transport fluid to the passage.

The internal dimensions of the passage downstream of the nozzle 16 can be adjusted by means of moveable wall sections 60, which can alter the mixing chamber wall profile between convergent, parallel and divergent at a plurality of sections along the mixing chamber 3A.

An additive fluid source 70 may be provided to add one or more fluids to the working fluid. An additive fluid valve 72 can be used to control the flow rate of the additive fluid, including to switch the flow on or off as appropriate. Separate heating means may be provided for the additive fluid, which may be a heated liquid, a gas such as steam or a mixture. The additive may be a powder, and may be introduced through a valve means from a secondary hopper.

Control means such as a microprocessor may be provided to control some or all of the parameters described above as appropriate. The control means can be linked to the condensation monitoring devices, such as the pressure sensors P1, P2, P3 which monitor the condensation shock wave, or any other sensor means eg temperature or acoustic sensors.

The versatility of the fluid mover of the present invention allows it to be applied in many different applications over a wide range of operating conditions. Two of these applications will now be described, by way of example, to illustrate the industrial applicability of the fluid mover of the present invention.

The first of the applications is a method of activating starch. The nature of the energy transfer between the transport fluid and the working fluid affords significant advantages for use in starch activation. Due to the intimate mixing between the hot transport fluid and the working fluid, very high heat transfer rates between the fluids are achieved resulting in rapid heating of the working fluid. In addition, the high energy intensity within the unit, especially the high momentum transfer rates between the steam and working fluid result in high shear forces on the working fluid. It is therefore this combination of heat and shear that result in enhanced starch activation.

The fluid mover may be incorporated in either a batch or a single pass fluid processing configuration. One or more fluid movers may be used, possibly mounted in series in a single pipeline configuration. A single fluid mover may pump, heat, mix, and activate the starch, or a separate pump may be used to pass the working fluid through the fluid mover. Alternatively, two or more fluid movers may be used in series, each fluid mover may be configured and optimized to carry out different roles. For example, one fluid mover may be configured to pump and mix (and do some initial heating) and a second fluid mover mounted in series down stream of the first, optimized to heat.

The energy intensity within the fluid mover is controllable. By controlling the flow rates of the steam and/or the working fluid, the intensity can be reduced to allow slow heating of the working fluid, and provide a much lower shear intensity. This could be used, for example, to provide gentle heating of the working fluid to maintain a batch of working fluid at a constant temperature without causing any shear thinning.

This method may also be employed for entraining, mixing in, dispersing and dissolving other hard-to-wet powders commonly employed in the food industry, such as pectins. Pectins are typically used to thicken foods or form gels, and are activated by heat. Some pectins form thermoreversible gels in the presence of calcium ions whereas ethers rapidly form thermally irreversible gels in the presence of sufficient sugars. The intense mixing, agitation, shear and heating afforded by the Fluid Mover enhances these gelling processes.

By way of example only, a fluid mover has been used to pump, mix, homogenise, heat (cook) and activate the starch in the manufacture of a 65 kg batch of tomato based sauce. Conventional processing required the sauce to be heated to 85° C. to activate the starch. It was found, using the fluid mover to mix, heat and process the sauce, that the starch was activated at the much lower batch temperature of 70° C. Combining this saving in heating requirement with the highly efficient mixing and heating afforded by the fluid mover, the overall process time was reduced by up to 95% over the conventional tank heating and stirring method.

It has also been found that the Fluid Mover activates a higher percentage of the starch present in the mix than conventional methods. It is not uncommon with food mixes containing highly modified starches for a large percentage (greater than 50%) of the starch to sometimes remain inactivated. Activating a higher percentage of the starch provides an obvious commercial advantage of reducing the amount of starch that has to be added to a mix to achieve a target viscosity. A similar effect has been observed with the (relatively) expensive pectin. Reducing the amount of pectin that has to be added to a mix provides a significant cost saving to the process.

This method may alternatively be employed in the brewing industry. The brewing process requires the rapid mixing, heating and hydration of ground malt, known as grist, and activation of the starch. It has been found that this can be achieved using the method described in this invention, with the additional advantages of maintaining the integrity of both the enzymes and the husks of the grist. Maintaining integrity of the enzymes in the mix is important as they are required to convert the starch to sugar in a later process, and similarly, the husks are required to be of a particular size to form an effective filter cake in a later Lauter filtration process.

The second application offered by way of example is a method of enhancing bioethanol (biofuel) production using the fluid mover of the present invention. The nature of the energy transfer between the steam and the working fluid affords significant advantages for use in bioethanol production. Due to the intimate mixing between the hot transport fluid (steam) and the working fluid, very high heat transfer rates between the fluids are achieved resulting in rapid heating of the working fluid. In addition, the high energy intensity within the unit, especially the high momentum transfer rates between the steam and working fluid result in high shear forces on the working fluid.

Two or more fluid movers may be used in series, each fluid mover may be configured and optimized to carry out different roles. For example, one fluid mover may be configured to pump and mix (and do some initial heating) and a second fluid mover mounted in series down stream of the first, optimized to heat and macerate.

Utilising the method described in this invention, the process of mixing, heating, hydrating and macerating the carbohydrate polymers in the biomass can be achieved more rapidly and efficiently than conventional methods. Utilising the high shear and the presence of Shockwave allows the active chemical or biological components to be intimately mixed with the carbohydrate polymers more efficiently, enhancing the contact through pulping of the plant matter as it begins to breakdown. Although the method described in this invention utilizes high temperature and high shear, it is still suitable for use in an Enzymatic Hydrolysis process without damage to the enzymes.

The shape of the fluid mover of the present invention may be of any convenient form suitable for the particular application. Thus the fluid mover of the present invention may be circular, curvilinear or rectilinear, to facilitate matching of the fluid mover to the specific application or size scaling. The enhancements of the present invention may be applied to the fluid mover in any of these forms.

The fluid mover of the present invention thus has wide applicability in industries of diverse character ranging from the food industry at one end of the chain to waste disposal at the other end.

The present invention when applied to the fluid mover of the aforementioned patent affords particularly enhanced emuisification and homogenisation capability. Emuisification is also possible with the deployment of the fluid mover of the present invention on a once-through basis thus obviating the need for multi-stage processing. In this context also the mixing of different liquids and/or solids is enhanced by virtue of the improved shearing mechanism which affects the necessary intimacy between the components being brought together as exemplified heretofore.

The localised turbulence within the working fluid dispersion region provides rapid mixing, dispersion and homogenisation of a range of different fluids and materials, for example powders and oils.

The heating of fluids and/or solids can be effected by the use of the present invention with the fluid mover by virtue of the use of steam as the transport fluid and of course in this respect the invention has multi-capability in terms of being able to pump, heat, mix and disintegrate etc.

The fluid mover of the present invention may be utilised, for example, in the essence extraction process such as decaffeination. In this example the fluid mover may be utilised to pump, heat, entrain, hydrate and intimately mix a wide range of aromatic materials with a liquid, usually water.

The vapour-droplet flow region of the present invention provides a particular advantage for the hydration of powders. Even extremely hard-to-wet hydrophilic powders, for example Guar gum, may be entrained and dispersed into a fluid medium within this vapour-droplet region.

As has been disclosed above, the fluid mover of the present invention possesses a number of advantages in its operational mode and in the various applications to which it is relevant. For example the 'straight-through' nature of the fluid mover having a substantially constant cress section, with the bore diameter never reducing to less than the bore inlet, means that net only will fluids containing solids be easily handled but also any rogue material will be swept through the mover without impedance. The fluid mover of the present invention is tolerant of a wide range of particulate sizes and is thus not limited as are conventional ejectors by the restrictive nature of their physical convergent sections.

Modifications and improvements may be incorporated without departing from the scope of the invention as defined in the appended claims.

The invention claimed is:

1. A method of processing a working fluid, the method comprising the steps of:

presenting a fluid mover to the working fluid, the fluid mover having a straight-through passage of substantially constant cross section;

applying a substantially circumscribing stream of a transport fluid to the passage through an annular nozzle, the fluid mover further comprising a mixing chamber being formed within the passage downstream of the nozzle, wherein an internal wall of the passage upstream of the mixing chamber is provided with at least one groove that creates turbulence in the working fluid flow prior to any interaction between the working fluid and the transport fluid;

atomising the working fluid to form a dispersed vapour and droplet flow regime with locally supersonic flow conditions;

generating a supersonic condensation shock wave within the passage downstream of the nozzle by condensation of the transport fluid, wherein the nozzle internal geometry and the internal wall of the passage are so disposed and configured to optimise energy transfer between the transport fluid and working fluid, the position of the condensation shock wave remaining substantially constant under equilibrium flow;

inducing flow of the working fluid through the passage from an inlet to an outlet thereof; and changing the position of the condensation shock wave to vary the working fluid discharge from the outlet.

2. The method according to claim 1, wherein the transport fluid is steam.

3. The method according to claim 2, wherein the momentum flux ratio (M) lies in the range $5 \leqq M \leqq 40$.

4. The method according to claim 1, wherein M is in the range $2 \leqq M \leqq 70$.

5. The method according to claim 1 further comprising monitoring through a microprocessor coupled to at least one sensor one or more properties of the mixed fluids within the passage downstream of the nozzle which relate to the resulting condensation shockwave.

6. A fluid mover comprising:

a hollow body provided with a straight-through passage of substantially constant cross section with an inlet at one end of the passage and an outlet at the other end of the passage for the entry and discharge respectively of a working fluid;

a nozzle substantially circumscribing and opening into said passage intermediate the inlet and outlet ends thereof;

an inlet communicating with the nozzle for the introduction of a transport fluid; and a mixing chamber being formed within the passage downstream of the nozzle;

wherein an internal wall of the passage upstream of the mixing chamber is provided with at least one groove that creates turbulence in the working fluid flow prior to any interaction between the working fluid and the transport fluid; and wherein the nozzle internal geometry, the bore profile of the passage immediately upstream of the nozzle exit and the internal wall of the straight-through passage are so disposed and configured to optimise the energy transfer between the transport fluid and working fluid that in use through the introduction of transport fluid the working fluid or fluids are atomised to form a dispersed vapour/droplet flow regime with locally supersonic flow conditions within a pseudo-vena contracta, resulting in the creation of a supersonic condensation shock wave within the downstream mixing chamber by the condensation of the transport fluid.

7. A fluid mover according to claim 6 further comprising a transport fluid source in communication with the transport fluid inlet, wherein the transport fluid source is adapted to control the pressure of the transport fluid at the inlet such that a momentum flux ratio (M) between the transport fluid and the working fluid lies in the range $2 \leqq M \leqq 70$.

8. The method according to claim 6 wherein M is in the range $5 \leqq M \leqq 40$.

9. The fluid mover according to claim 7 further comprising a microprocessor coupled to the transport fluid source and to at least one sensor that monitors one or more properties of the mixed fluids within the downstream mixing chamber which relate to the resulting supersonic condensation shockwave, the microprocessor being adapted to allow the transport fluid source to control the pressure of the transport fluid based on information measured through the at least one sensor.

10. The fluid mover according to claim 6 wherein the passage is a substantially circular passage and the nozzle is an annular nozzle.

11. The fluid mover according to claim 6, wherein the nozzle is of convergent-divergent geometry internally thereof.

* * * * *